US007966670B2

(12) United States Patent
Wilbert et al.

(10) Patent No.: US 7,966,670 B2
(45) Date of Patent: Jun. 28, 2011

(54) MULTIPURPOSE GLOVE

(75) Inventors: Paula S. Wilbert, Dennis, MA (US); Judy L. Lawson, Collwich, KS (US)

(73) Assignee: Joint Protection Products LLC, Dennis, MA (US)

( * ) Notice: Subject to any disclaimer, the term of this patent is extended or adjusted under 35 U.S.C. 154(b) by 0 days.

(21) Appl. No.: 12/082,886

(22) Filed: Apr. 15, 2008

(65) Prior Publication Data

US 2008/0271224 A1 Nov. 6, 2008

(51) Int. Cl.
*A41D 19/00* (2006.01)

(52) U.S. Cl. ..... 2/161.1; 2/161.6

(58) Field of Classification Search ..... 2/161.1, 2/161.6, 163

See application file for complete search history.

(56) References Cited

U.S. PATENT DOCUMENTS

| | | | | | |
|---|---|---|---|---|---|
| 3,421,160 | A | * | 1/1969 | Salvatore | 2/159 |
| 4,071,913 | A | | 2/1978 | Rector | 2/20 |
| 4,796,306 | A | * | 1/1989 | Mitchell | 473/205 |
| 4,881,533 | A | | 11/1989 | Teurlings | 128/87 R |
| 5,330,249 | A | | 7/1994 | Weber et al. | 297/214 |
| 5,330,391 | A | | 7/1994 | Mitchell | 473/59 |
| 5,771,901 | A | | 6/1998 | O'Brien | 128/878 |
| 5,810,753 | A | | 9/1998 | Eberbach | 602/21 |
| 5,896,584 | A | | 4/1999 | Hauser | 2/161.1 |
| 5,937,444 | A | | 8/1999 | Hochmuth | 2/161.1 |
| 6,006,751 | A | | 12/1999 | Spitzer | 128/878 |
| 6,098,200 | A | | 8/2000 | Minkow et al. | 2/161.1 |
| 6,216,276 | B1 | | 4/2001 | Eibert | 2/161.2 |
| 6,389,596 | B2 | | 5/2002 | LoMedico | 2/20 |
| 6,517,501 | B1 | | 2/2003 | Slautterback | 602/5 |
| 6,532,594 | B1 | | 2/2003 | Barnett | 2/20 |
| 6,678,986 | B2 | | 1/2004 | Roush | 42/94 |
| 6,701,529 | B1 | | 3/2004 | Rhoades et al. | 2/2.5 |
| 6,708,346 | B2 | | 3/2004 | Terris et al. | 2/161.2 |
| 6,775,847 | B2 | | 8/2004 | Terris et al. | 2/161.1 |
| 6,845,514 | B1 | | 1/2005 | Yao | 2/16 |
| 6,880,269 | B2 | | 4/2005 | Falone et al. | 36/44 |

(Continued)

FOREIGN PATENT DOCUMENTS

DE 0961431 C 4/1957

OTHER PUBLICATIONS

Supplementary European Search Report, dated Jan. 10, 2009, for counterpart European Patent Application No. EP 0581 8741, filed May 15, 2007.

(Continued)

*Primary Examiner* — Katherine Moran
(74) *Attorney, Agent, or Firm* — Pollack, P.C.

(57) ABSTRACT

A multipurpose glove is disclosed which comprises a relatively resilient body for snug fit reception of a user's hand. The body includes a first opening on a first side for receiving the user's hand, a second opening branching from a second side of the body for receiving the user's thumb, and a plurality of third openings oriented multidirectionally. Each of the third openings receives at least one finger of the user, and at least one of the third openings has a size and shape suitable for receiving and supporting at least two of the user's fingers generally simultaneously upon engagement of the glove with the user's hand. A contoured, resilient pad is mounted in a base portion of the body corresponding to and for engaging the palm of the user's hand.

4 Claims, 17 Drawing Sheets

U.S. PATENT DOCUMENTS

| | | | | |
|---|---|---|---|---|
| 6,944,974 | B2 | 9/2005 | Falone et al. | 36/44 |
| 7,415,735 | B2 * | 8/2008 | Erickson et al. | 2/163 |
| 2004/0060096 | A1 * | 4/2004 | Thiruppathi | 2/161.1 |
| 2004/0250330 | A1 | 12/2004 | Berman | 2/20 |
| 2008/0092269 | A1 | 4/2008 | Schox | 2/159 |

OTHER PUBLICATIONS

Complaint And Jury Demand dated May 22, 2007, *Nancy Q. Proctor* v. *Paula S. Wilbert*, Barnstable Superior Court, Civil Action No. BACV2007-00284A.

Defendant, Paula Wilbert's Answer To Plaintiffs Complaint And Demand For Jury Trial dated Jun. 14, 2007, *Nancy Q. Proctor* v. *Paula S. Wilbert*, Barnstable Superior Court, Civil Action No. BACV2007-00284A.

Letter from Pollack, P.C. to Morrison, Mahoney & Miller, LLP dated Apr. 24, 2007.

Letter from Morrison, Mahoney & Miller, LLP to Pollack, P.C. dated Apr. 19, 2007.

Letter from Morrison, Mahoney & Miller, LLP to Pollack, P.C. dated Apr. 9, 2007.

Shock-Tek (TM) Cycling/Athletic Glove packaging.

Fellowes Wrist Rest (TM) Advertisement.

Belkin WaveRest (TM) Wrist Pad © 2000.

Notification Of Transmittal Of The International Search Report And The Written Opinion Of The International Searching Authority dated Jun. 20, 2006, for counterpart International Patent Application No. PCT/US05/38672, filed Oct. 25, 2005.

* cited by examiner

MULTIPURPOSE GLOVE

This Application is based on U.S. Provisional Application Ser. No. 60/621,977, filed Oct. 25, 2004, the disclosure of which is hereby incorporated by reference herein in its entirety.

FIELD OF THE INVENTION

The present invention relates generally to devices for improving physical condition and well-being of a user's hand and, more particularly, to gloves for improving comfort, strength, performance and/or imparting a therapeutic effect to a hand or the like.

BACKGROUND OF THE INVENTION

Conventional gloves for exercise, fitness and conditioning, athletic activities and the like typically comprise a hollow body formed in the shape of a user's hand, either in full-finger, half-finger or fingerless design, and constructed of cushioned and/or other pliable materials for desired levels of comfort and protection during use. The configuration of each glove is often dictated by the application(s) to which it is intended. Whether the glove is designed for golf, gardening, bowling, football, baseball, cycling, weightlifting, handball, riflery, Yoga or other activities, each glove is characterized by a hollow body with full to half-finger coverage made of a stretchable material or non-stretchable and formed in the shape of a user's hand with padding directed primarily on those portion(s) of the glove that typically engage objects or surfaces where added protection is needed.

Due to increased participation in sports and exercise activities in recent years as well as heightened awareness of the importance of ergonomics, such as proper body positioning, a variety of commercial glove products have been developed in an attempt not only to prevent or decrease the frequency of injury, but also to absorb shock and reduce impact and compression on the user's nerves and joints, especially in the hand and wrist. Cycling gloves, for instance, are considered particularly representative in providing a padded palm, half-finger design with grooved channels. An objective of these gloves is to provide suitable protection to the user's palm, improve comfort and grip, while decreasing nerve compression. Similarly, weight lifting gloves, golfing gloves, batting gloves and other sport specific gloves have been designed for enhancing grip, form, comfort, protection and performance of the user. Conventional sports and exercise gloves, it has been found, have one thing in common, namely, padding in the palm portion of the glove.

Gloves intended for aiding the user when engaging in floor exercise activities, e.g., Yoga, Pilates and upper body strengthening exercise such as pushups, are usually directed to slippage reduction of the user's hand during use. Some Yoga gloves provide a non-skid material over the palm portion of the glove. These gloves are used alternatively to or concurrently with props and other freestanding tools intended to modify body posture, body position, and/or relieve stress on the user's wrist. Such props include, for example, a foam wedge or a suspended bar (known as a Gripitz®) for grasping by a neutral wrist instead of assuming an extended wrist and finger position. While the use of props with or without gloves has been found relatively effective, the need for freestanding tools requires that the user interrupt his or her exercise routine in order to suitably position (or reposition) the props.

As for gloves designed for support and treatment of hand-related ailments such as arthritis and carpal tunnel syndrome, such gloves usually focus on a design that, while suitable for the treatment intended, inhibits flexibility or immobilizes the hand and/or wrist. Examples of these gloves include tight fitting elastic, thermoplastic or neoprene gloves with splints or laced webbing for limiting or restricting wrist, hand and/or finger movement.

Although conventional gloves, whether for sports, exercise or medical treatment, are often suitable for the activities and applications for which they are designed, and may be useful for other activities and applications for which they are not, not only has padding and protection at, or in proximity to, the wrist joint and palm been found inadequate, but also the comfort and performance of the glove is often hindered by features used for protection of the user's hand and vice versa.

OBJECTS AND SUMMARY OF THE INVENTION

According to one aspect of the present invention, a glove is provided which comprises: a relatively resilient body for snug fit reception of a user's hand, the body including a first opening on a first side for receiving the user's hand, a second opening branching from a second side of the body for receiving the user's thumb, and a plurality of third openings oriented multidirectionally, each of the third openings for receiving at least one finger of the user, at least one of the third openings having a size and shape suitable for receiving and supporting at least two of the user's fingers generally simultaneously upon engagement of the glove with the user's hand; and a contoured, resilient pad mounted in a base portion of the body corresponding to and for engaging the palm of the user's hand, the pad having, along one face, at least one lobed portion, e.g., clover or petal shaped, and being molded so as to generally fit the contour of the palm, the opposite face being relatively flat for engaging an interior portion of the base portion, the palm portion of the pad corresponding to the lobed portion being generally greater in thickness than that corresponding to the ball of the hand, whereupon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist.

In accordance with another aspect of the present invention, a glove is provided which comprises: a relatively resilient body for snug fit reception of a user's hand, the body including a first opening on a first side for receiving the user's hand, a second opening branching from a second side of the body for receiving the user's thumb, and a plurality of third openings oriented multidirectionally, each of the third openings for receiving at least one finger of the user, at least one of the third openings having a size and shape suitable for receiving and supporting at least two of the user's fingers generally simultaneously upon engagement of the glove with the user's hand; and a contoured, resilient pad mounted in a base portion of the body corresponding to and for engaging the palm of the user's hand, the pad having, along one face, a plurality of lobed portions, e.g., clover or petal shaped, and being molded so as to generally fit the contour of the palm, the opposite face being relatively flat for engaging an interior portion of the base portion, the palm portion of the pad corresponding to the lobed portions being generally greater in thickness than that corresponding to the ball of the hand, whereupon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist.

According to a further aspect of the present invention, there is provided a glove comprising a relatively resilient body for snug fit reception of a user's hand. The body includes a first opening on a first side for receiving the user's hand, a second opening branching from a second side of the body for receiving the user's thumb, and a plurality of third openings oriented multidirectionally, each of the third openings for receiving at least one finger of the user. At least one of the third openings is sized and shaped suitably for receiving and supporting at least two of the user's fingers generally simultaneously upon engagement of the glove with the user's hand. A contoured, resilient pad mounted in a base portion of the body corresponds to and for engages the palm of the user's hand, the pad having, along one face, at least one lobed portion, e.g., clover or petal shaped, and is molded so as to generally fit the contour of the palm, the opposite face being relatively flat for engaging an interior portion of the base portion, the palm portion of the pad corresponding to the lobed portion being generally greater in thickness than that corresponding to the ball of the hand, whereupon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist. In addition, a contoured, resilient pad is mounted in a finger portion of the body corresponding to and for engaging a palm side of the user's thumb. The pad has, along one face, at least one sloping trough shaped portion and is molded so as to generally fit the contour of the thumb, the opposite face being relatively flat for engaging an interior portion of the base portion. The sloping trough shaped portion of the pad corresponding to a proximal portion of the thumb is generally greater in thickness than that corresponding to a distal portion of the thumb, whereupon engagement of the pad with the user's thumb, and of an exterior portion of the finger portion with a selected supporting surface, the pad causes the proximal portion to be lifted a selected distance generally greater than the distance of lift of the distal portion, so as to minimize stress on the user's wrist, hand and/or thumb.

In accordance with still another aspect of the present invention, there is provided a glove comprising a relatively resilient body for snug fit reception of a user's hand. The body includes a first opening on a first side for receiving the user's hand, a second opening branching from a second side of the body for receiving the user's thumb, and a plurality of third openings oriented multidirectionally, each of the third openings receiving at least one finger of the user. At least one of the third openings is sized and shaped suitably for receiving and supporting at least two of the user's fingers generally simultaneously upon engagement of the glove with the user's hand. A contoured, resilient pad mounted in a base portion of the body corresponds to and engages the palm of the user's hand, the pad having, along one face, a plurality of lobed portions, e.g., clover or petal shaped, and being molded so as to generally fit the contour of the palm, the opposite face being relatively flat for engaging an interior portion of the base portion. The palm portion of the pad corresponding to the lobed portions is generally greater in thickness than that corresponding to the ball of the hand, whereupon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist. In addition, a contoured, resilient pad is mounted in a finger portion of the body corresponding to and for engaging a palm side of the user's thumb. The pad has, along one face, at least one sloping trough shaped portion and is molded so as to generally fit the contour of the thumb, the opposite face being relatively flat for engaging an interior portion of the base portion. The sloping trough shaped portion of the pad corresponding to a proximal portion of the thumb is generally greater in thickness than that corresponding to a distal portion of the thumb, whereupon engagement of the pad with the user's thumb, and of an exterior portion of the finger portion with a selected supporting surface, the pad causes the proximal portion to be lifted a selected distance generally greater than the distance of lift of the distal portion, so as to minimize stress on the user's hand and wrist.

Still another aspect of the present invention is directed to a glove which comprises a relatively resilient body for snug fit reception of a user's hand, the body including a first opening on a first side for receiving the user's hand, a second opening branching from a second side of the body for receiving the user's thumb, and a plurality of third openings oriented multidirectionally. Each of the third openings receives at least one finger and preferably at least two fingers of the user upon engagement of the glove with the user's hand. A contoured, resilient pad is mounted in a base portion of the body corresponding to and for engaging the palm of the user's hand. The pad has, along one face, one or more lobed portions and is molded so as to generally fit the contour of the palm, the opposite face being relatively flat for engaging an interior portion of the base portion. The ball portion of the pad corresponding to the lobed portion(s) is generally greater in thickness than that corresponding to the palm portion of the hand. Upon engagement of the pad with the user's palm, and of an exterior portion of the base portion with a selected supporting surface, the pad causes the ball and midsection of the palm to be lifted a selected distance generally greater than the distance of lift of the base of the user's palm, so as to minimize stress on the user's hand. Optionally, a contoured, resilient pad is also mounted in a finger portion of the body corresponding to and for engaging a palm side of the user's thumb. The pad has, along one face, at least one sloping trough shaped portion and is molded so as to generally fit the contour of the thumb, the opposite face being relatively flat for engaging an interior portion of the base portion. The sloping trough shaped portion of the pad corresponding to a distal portion of the thumb is generally greater in thickness than that corresponding to a proximal portion of the thumb. Alternatively, the sloping trough shaped portion of the pad corresponding to a proximal portion of the thumb is generally greater in thickness than that corresponding to a distal portion of the thumb. Upon engagement of the pad with the user's thumb, and of an exterior portion of the finger portion with a selected supporting surface, the pad causes the distal portion to be lifted a selected distance generally greater than the distance of lift of the proximal portion, so as to minimize stress on the user's hand.

Yet another aspect of the present invention is directed to a contoured, resilient pad corresponding to and for engaging the palm and wrist of a user's hand. The pad has, along one face, at least one lobed portion, e.g., clover or petal shaped, and is molded so as to generally fit the contour of the palm. The opposite face of the pad is relatively flat for engaging at least indirectly a selected support surface. The palm portion of the pad corresponding to the lobed portion is generally greater in thickness than that corresponding to the ball of the hand, whereupon engagement of the pad with the user's palm, and of the opposite face with the selected supporting surface, the pad causes the base of the palm to be lifted a selected distance generally greater than the distance of lift of the ball and midsection of the user's palm, so as to minimize stress on the user's hand and wrist.

Still a further aspect of the present invention relates to a contoured, resilient pad corresponding to and for engaging a user's thumb. The pad has, along one face, at least one sloping trough shaped portion and is molded so as to generally fit the contour of the thumb. The opposite face of the pad is relatively flat for engaging at least indirectly a selected support surface. The sloping trough shaped portion of the pad corresponding to a proximal portion of the thumb is generally greater in thickness than that corresponding to a distal portion of the thumb, whereupon engagement of the pad with the user's thumb, and of the opposite face with the selected supporting surface, the pad causes the proximal portion to be lifted a selected distance generally greater than the distance of lift of the distal portion, so as to minimize stress on the user's wrist, hand and/or thumb.

In accordance with yet a further aspect of the present invention, a method is provided for making a multipurpose glove. Initially, a body of the glove is formed of a relatively resilient material for snug fit reception of a user's hand. A first opening is then formed on a first side of the body for receiving the user's hand, a second opening is formed in the body branching from a second side thereof for receiving the user's thumb, and a plurality of third openings oriented multidirectionally are formed, each of the third openings for receiving at least one finger of the user, at least one of the third openings having a size and shape suitable for receiving and supporting at least two of the user's fingers generally simultaneously upon engagement of the glove with the user's hand. Adjacent openings define a notch for guiding the finger passing therethrough into position, and for maintaining and securing the glove in a desired position on the hand. Next, a contoured, resilient pad is mounted in a base portion of the body, the pad corresponding to and for engaging the palm and wrist of the user's hand, the pad having, along one face, one or more lobed portions and being molded so as to generally fit the contour of the palm, the opposite face being relatively flat for engaging an interior portion of the base portion. The palm portion of the pad corresponds to the one or more lobed portions being generally greater in thickness than that corresponding to the ball of the hand. Upon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist. Optionally, an additional step is performed, namely, associating an adjustable tab member or strip with the notch for removable engagement of a user's finger with the glove body so as to maintain the fingers in a desired position and/or adjust the fit of the glove. As a further option, and alternatively or currently therewith, is a step of mounting a contoured, resilient pad in a finger portion of the body corresponding to and for engaging a palm side of the user's thumb. The pad has, along one face, at least one sloping trough shaped portion and being molded so as to generally fit the contour of the thumb. The opposite face is relatively flat for engaging an interior portion of the base portion. The sloping trough shaped portion of the pad corresponding to a proximal portion of the thumb is generally greater in thickness than that corresponding to a distal portion of the thumb. Upon engagement of the pad with the user's thumb, and of an exterior portion of the finger portion with a selected supporting surface, the pad causes the proximal portion to be lifted a selected distance generally greater than the distance of lift of the distal portion, so as to minimize stress on the user's wrist, hand and/or thumb.

Still another aspect of the present invention is directed to a method for securing a multipurpose glove to a user's hand. The glove has a body of a relatively resilient material for snug fit reception of a user's hand, the body including a first opening on a first side for receiving the user's hand, a second opening branching from a second side of the body for receiving the user's thumb, and a plurality of third openings oriented multidirectionally. Each of the third openings receives at least one finger of the user, at least one of the third openings having a size and shape suitable for receiving and supporting at least one and preferably two of the user's fingers generally simultaneously upon engagement of the glove with the user's hand. Adjacent openings define a notch for guiding the finger passing therethrough into position, and for maintaining and securing the glove in a desired position on the hand. In this connection, the user first passes his or her hand and fingers through the first opening, pulling the glove body over the hand. Each finger of the hand is in alignment with a corresponding first, second and third opening in the body, such that each finger is guided by the corresponding opening and passes therethrough so as to achieve snug fit reception of the user's hand and fingers. At least one web portion between adjacent fingers engages and abuts an adjustable tab member associated with the notch, the tab member being removably attached to the glove body for maintaining and securing the user's fingers in a desired position. Next, the tab member is detached from one side of the glove body, and pulled through those of the user's fingers between which it is positioned to a selected tightness so as to adjust the fit of the glove and accommodate various palm lengths of the user. Finally, the tab member is fastened to the one side of the glove body so as to maintain the selected degree of tightness during use.

It is, therefore, an object of the present invention to provide an ergonomically padded, form fitting, non slip glove design that combines the comfort and stability of anatomically correct protection with the convenience of wearing a glove throughout a selected activity such as an exercise routine including weight bearing activity on the hand.

Another object of the present invention is to provide a glove such as for sports or fitness that is constructed of a relatively soft fabric that stretches and snugly fits a user's hands.

A further object of the present invention is to provide a glove constructed of a material having stretch properties along with an elastic band above the wrist that eases donning of the glove over a greater surface of the palm.

Still another object of the present invention is to provide a glove that includes a thumb piece and an index-middle finger notch for correct positioning the glove on the hand and maintaining the glove in such position, while the fingers remain relatively free.

Yet another object of the present invention is to provide a glove having a fabric ban notch between the ring and middle fingers so as to correctly position the glove on the hand and maintaining the glove in such position.

Still a further object of the present invention is to provide a glove having palm portions made of a non-skid coating or fabric to prevent slippage during weight bearing activities, such as hands down weight bearing exercise postures.

Yet a further object of the present invention is to provide a glove that includes strategically placed thin or flat panels of silicone, viscoelastic polymer gel, thermoplastic elastomer (TPE) gel, thermoplastic rubbers (TPR), liquid filled pads or the like for improving comfort and equalizing vertical pressure at the point of contact between the user and a selected surface.

It is another object of the present invention is to provide a glove that reduces soft tissue compression and associated pain during use, especially in weight bearing activities on the hand.

A further object of the present invention is to provide a form fitting, non-slip glove design with ergonomically placed gel padding that combines comfort and stability of anatomically correct positioning with the convenience of wearing a glove throughout an exercise routine.

It is yet another object of the present invention is to provide a glove for sports or exercise having an enclosed thumb piece support and index-middle finger notch for maintaining the glove positioned correctly on the hands, while the fingers remain free.

Still another object of the present invention is to provide a glove with a fabric ban (notch) between the ring and little finger, if needed, to maintain the glove in place and positioned correctly.

Yet a further object of the present invention is to provide a form fitting, non-slip glove with ergonomically placed gel padding and a non-skid coating or fabric on the palm to prevent slippage during weight bearing postures or the like.

It is still a further object of the present invention to provide a sports-fitness glove that not only yields increased comfort to the user, but also minimizes stress and strain on soft tissues (e.g., nerves, ligaments, tendons, muscles and blood vessels) associated with prolonged or repeated stretch and pressure upon weight bearing with the wrist in a fully extended position on a rigid surfaces (such as a floor during Yoga, Pilates or pushups, handle bars during cycling, the ground while gardening, waitressing, keyboarding or the like).

Another object of the present invention is to provide a multipurpose glove that prevents the user from bearing of his or her weight on the hands during exercise or other activities with the wrists in full extension or hyperextension (i.e., at a 90° angle or greater).

BRIEF DESCRIPTION OF THE DRAWINGS

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
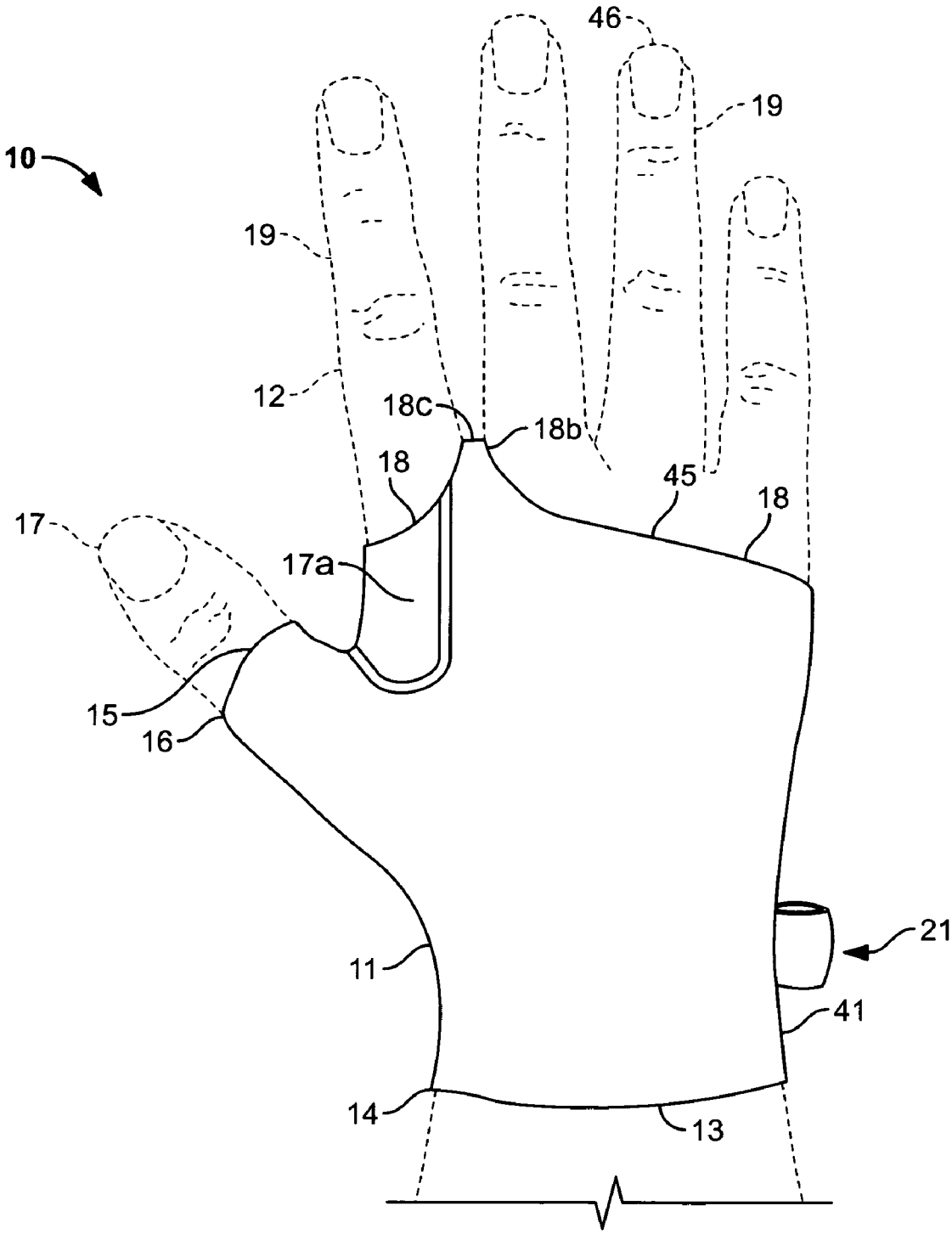
FIG. 1 is a plan view of a multipurpose glove utilizing a one notch arrangement between the user's index and middle fingers, according to one aspect of the present invention.

Referring now to the drawings and, more particularly, to FIGS. 1-20, there is shown generally a specific, illustrative, multipurpose glove, according to various aspects of the present invention. In one embodiment, shown generally in FIG. 1, a multipurpose glove 10 is provided which comprises a relatively resilient body 11 for snug fit reception of a user's hand 12. The body is preferably constructed of a relatively soft fabric (or multiple fabrics) that stretches suitably and fits snugly on the user's hand. Preferably, an open cell fabric is utilized for allowing air to flow in and moisture to pass out, or an advanced fabric that increases oxygenation levels in the blood, e.g., between about 8% and about 30%, so as to promote blood flow, injury healing and muscle recovery. Acceptable materials include, but are not limited to, Spandex, Lycra®, Lycra® blends, a cotton-Lycra® mesh, a moisture wicking fabric, a lightweight breathable mesh, leather, a synthetic leather, neoprene, an open cell fabric such as Breath-O-Prene®, Holofiber®, or the like, within the spirit and scope of the present invention. An objective of the glove body is to achieve a relatively snug fit and/or provide uniform compression for comfort and general wellness.

Figure 2:
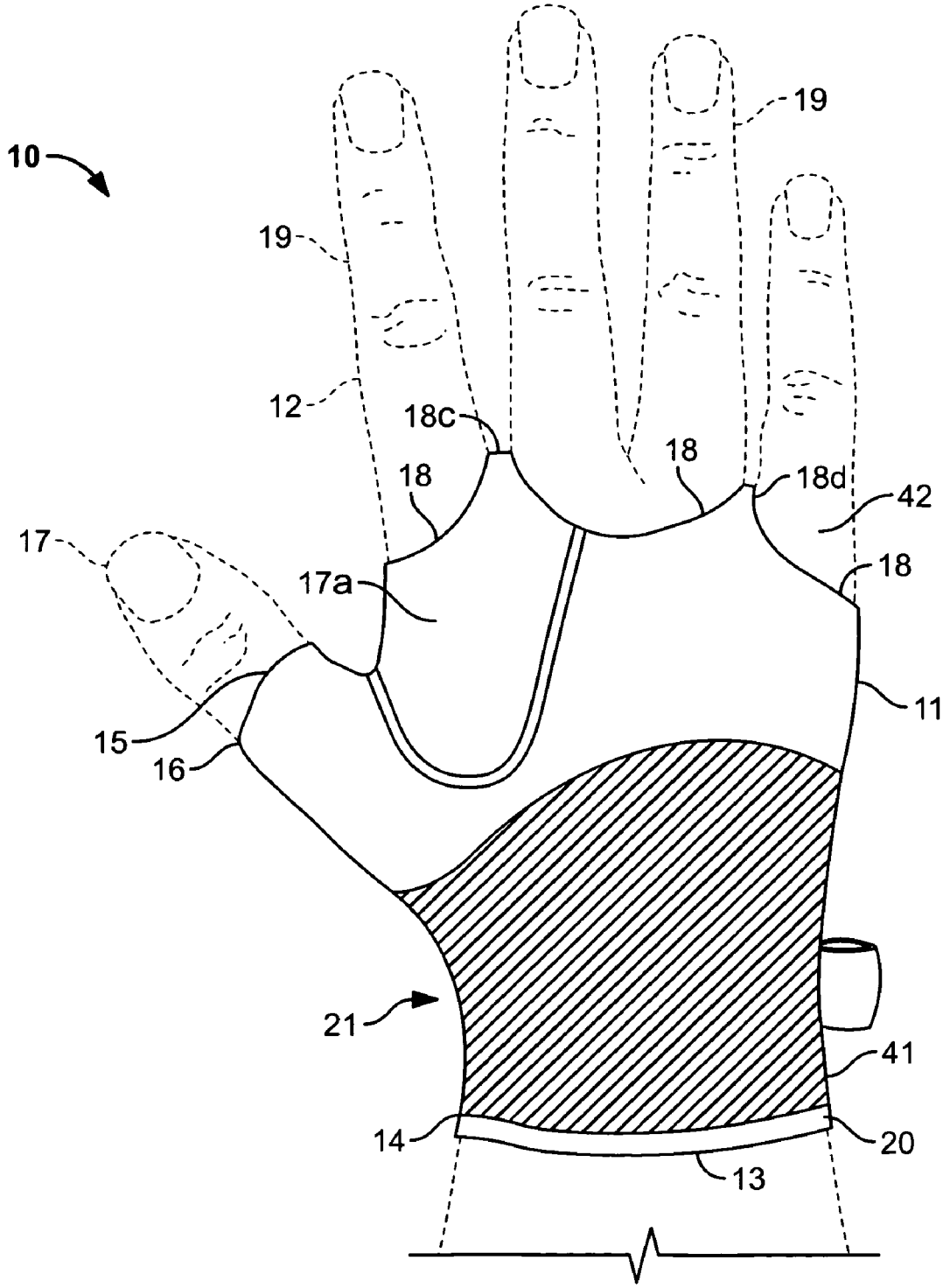
FIG. 2 is a plan view of a multi-panel, multipurpose glove with a two notch arrangement, one notch between the user's index and middle finger and another between the user's ring and little finger, in accordance with another aspect of the present invention.
Figure 3:
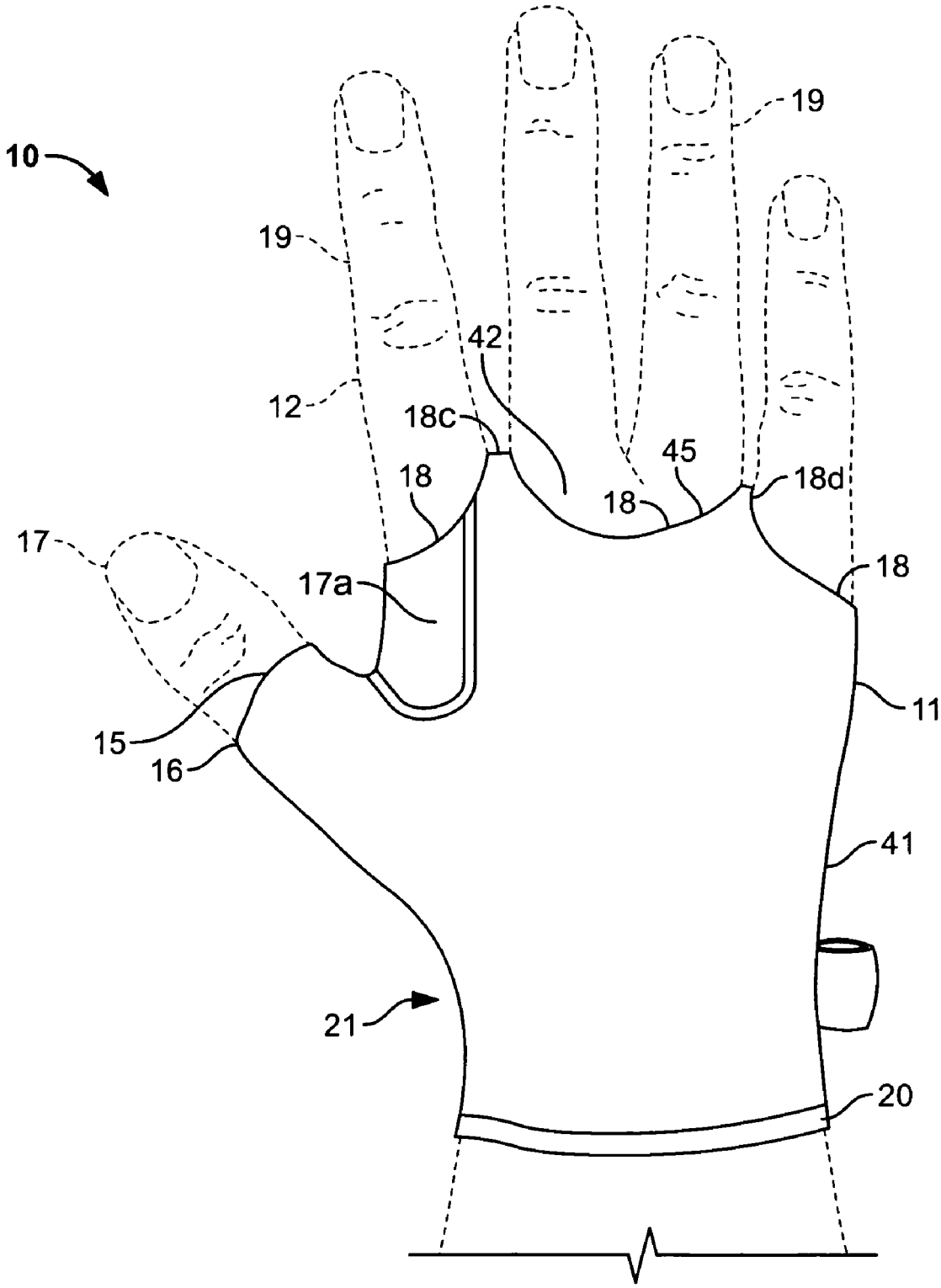
FIG. 3 is a plan view of a multi-panel, multipurpose glove with a two notch arrangement, according to a further aspect of the present invention.
Figure 4:
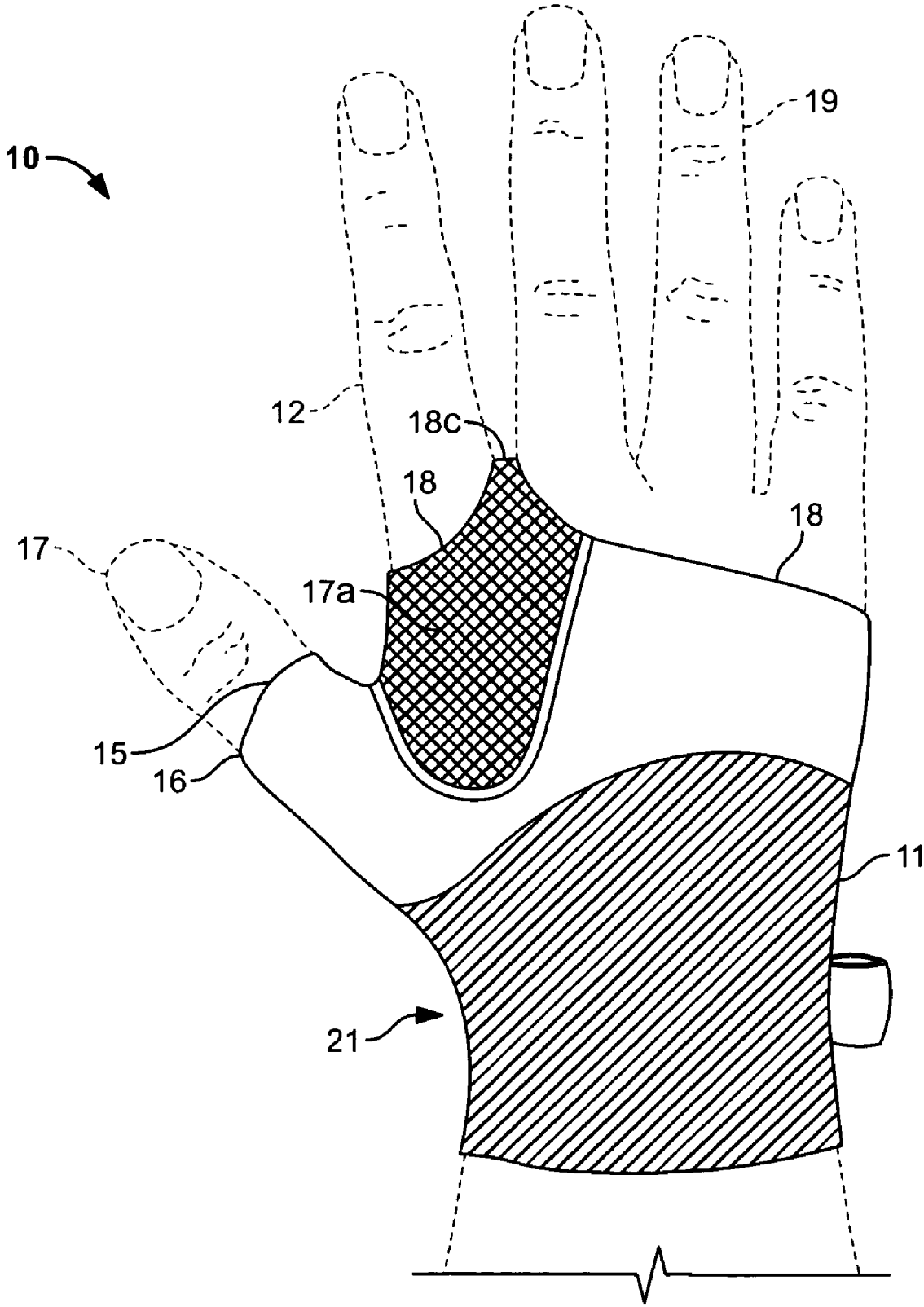
FIG. 4 is a plan view of a multipurpose glove utilizing a one notch arrangement, according to yet another aspect of the present invention.

Structurally, the body includes a first opening 13 on a first side 14 for receiving the user's hand, a second opening 15 branching from a second side 16 of the body for receiving the user's thumb 17, and a plurality of third openings 18 oriented multidirectionally. Each of the third openings receives at least one finger 19 of the user, and at least one of the third openings 18*a* has a size and shape suitable for receiving and supporting at least one and preferably two of the user's fingers generally simultaneously upon engagement of the glove with the user's hand. These openings, pursuant to accommodating one or more of the user's fingers, of adjacent fingers define one or more notches 18*b*, e.g., of fabric, therebetween for guiding the fingers passing therethrough into position and for maintaining and/or securing the glove in a desired position on the hand while the fingers remain relatively free. Additionally, a selected material, such as a mesh, may be located in the thumb web space 17*a* for comfort and/or support. In one arrangement, best seen in FIGS. 1 and 4, an index-middle finger notch 18*c* is provided. According to another embodiment, index-middle finger notch 18*c* and a ring-little finger notch 18*d* are provided. A notch configuration of this general description is illustrated in FIGS. 2 and 3.

Although the present invention is shown and described as having one of the third openings suitably sized and shaped for receiving two adjacent fingers, those skilled in the art will appreciate that other configurations of the third openings may be utilized, giving consideration to the purpose for which the present invention is intended. For instance, alternatively or concurrently, one or more of such third openings are configured for receiving one finger, two fingers, three fingers or the like, within the spirit and scope of the present invention.

Figure 5:
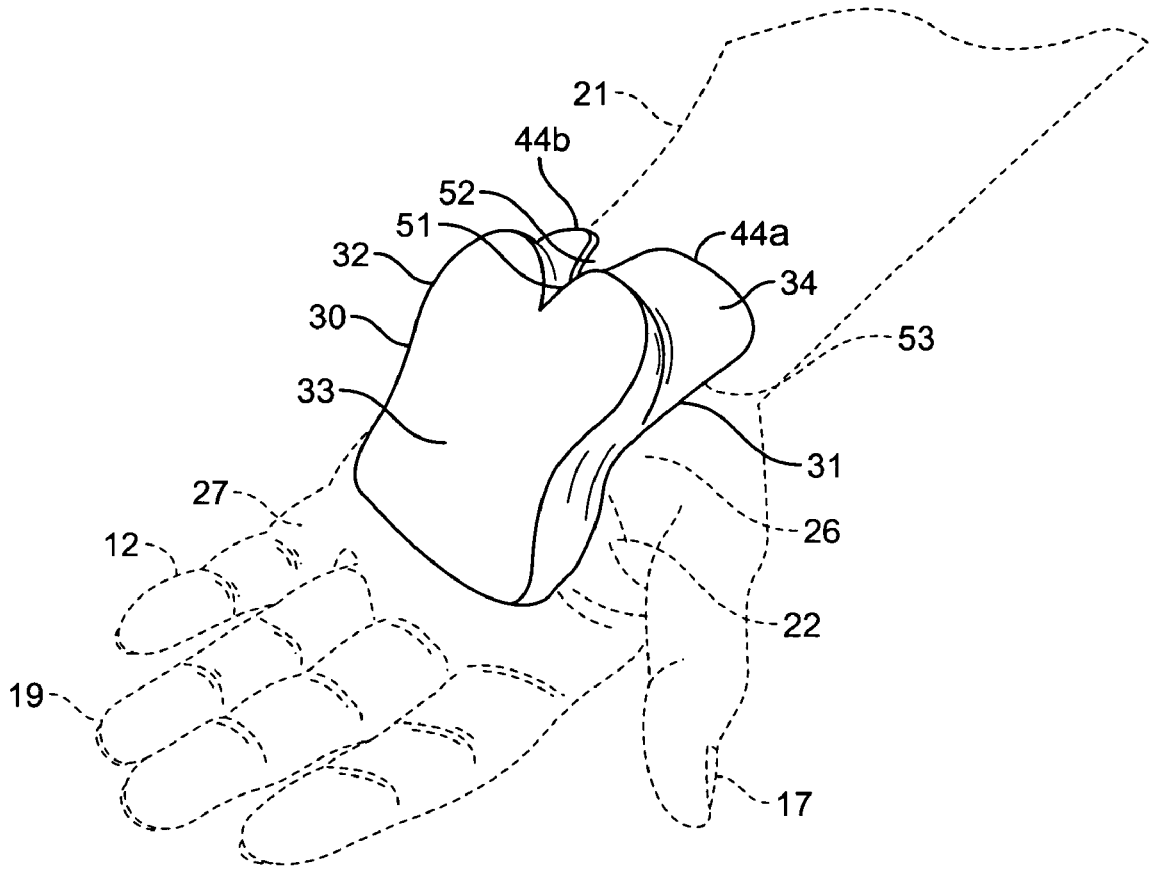
FIG. 5 is a perspective view of a contoured, resilient pad corresponding to and engaged with the palm of a user's hand, according to one aspect of the present invention.
Figure 9:
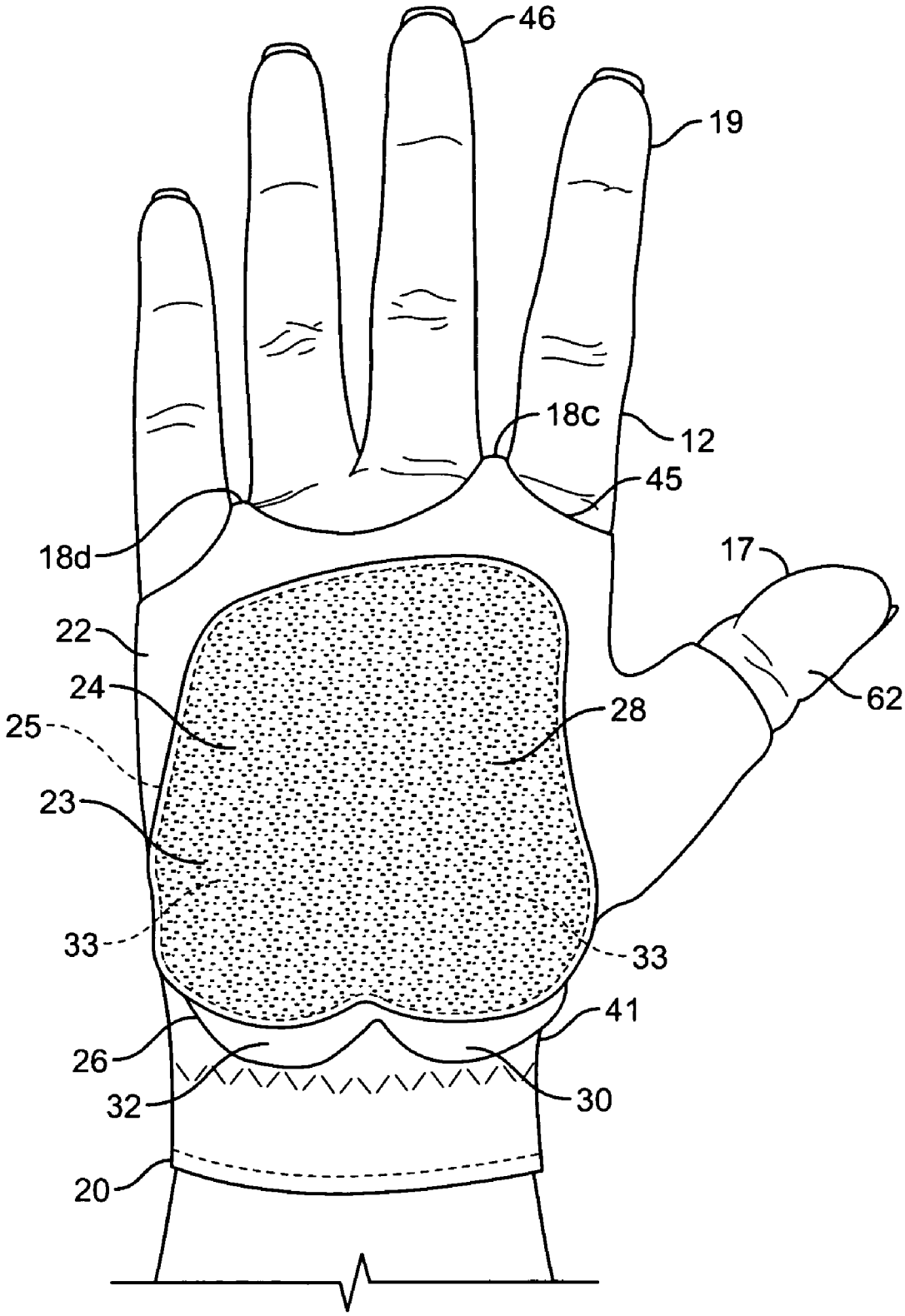
FIG. 9 is a reverse plan view of the glove shown in FIG. 8 showing the palm portion of the glove, according to one aspect of the present invention.

Optionally, the body also includes an elastic band 20, preferably located for engagement of the user's hand above his or her wrist 21 to ease donning the glove over a generally wider surface of the user's palm 22 (See FIG. 5). Alternatively or concurrently, as illustrated in FIG. 9, one or more of the gloves is provided with a non-skid surface 23 on their respective palms for minimizing or preventing slippage during weight bearing activities. Suitable palm surfaces include, but are not limited to, a conventional non-skid rubberized coating, non-skid fabric, PVC dotting, a criss-cross pattern of one or more skid resistant materials, or other conventional or non-conventional material and/or pattern (adhered or imprinted thereon) that can be effective for reducing slippage during use. In addition, placement of the non-skid surface may be over the entire surface of the palm, below the metacarpal phalangial joints, at the wrists and the thenar eminance (or thumb), hypo-thenar eminance (or little finger) of the palm, or other placement that, in whole or part, is deemed necessary for minimizing or eliminating slippage.

Figure 19A:
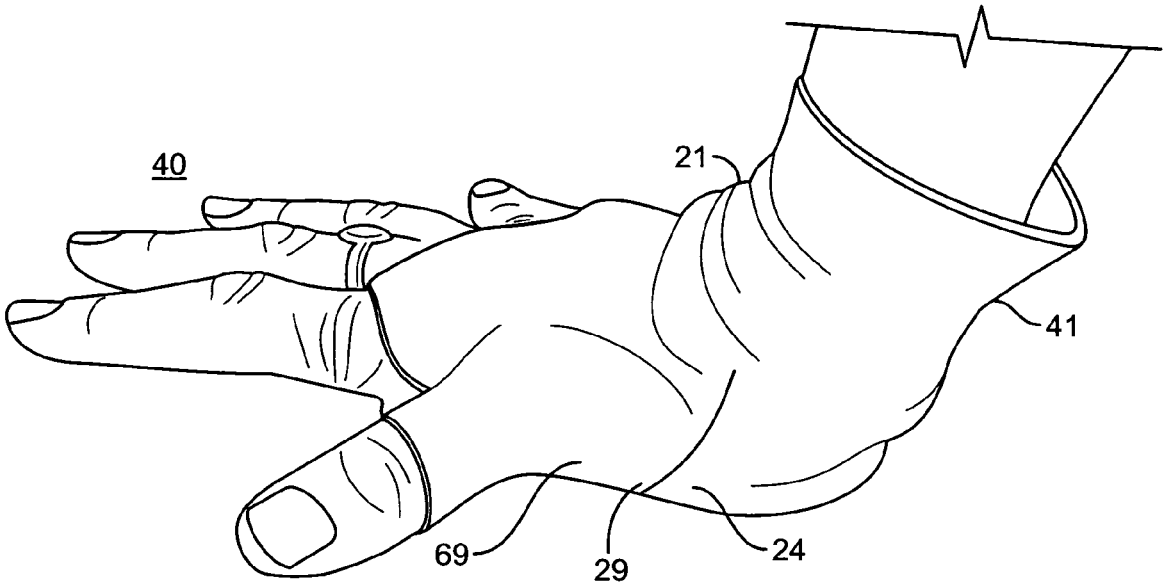
FIG. 19A is perspective view of a user's hand wearing a multipurpose glove, according to the present invention, the hand being engaged in a weight bearing activity against a relatively hard surface.
Figure 19B:
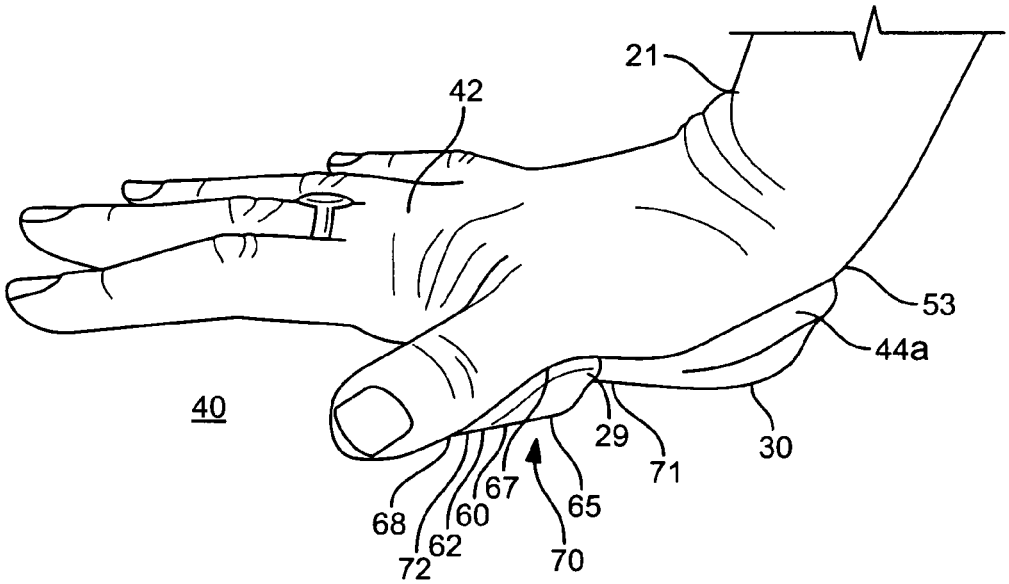
FIG. 19B is perspective view of a user's hand cradled by contoured, resilient pads without the multipurpose glove, according to the present invention, the hand being engaged in a weight bearing activity against a relatively hard surface.
Figure 20:
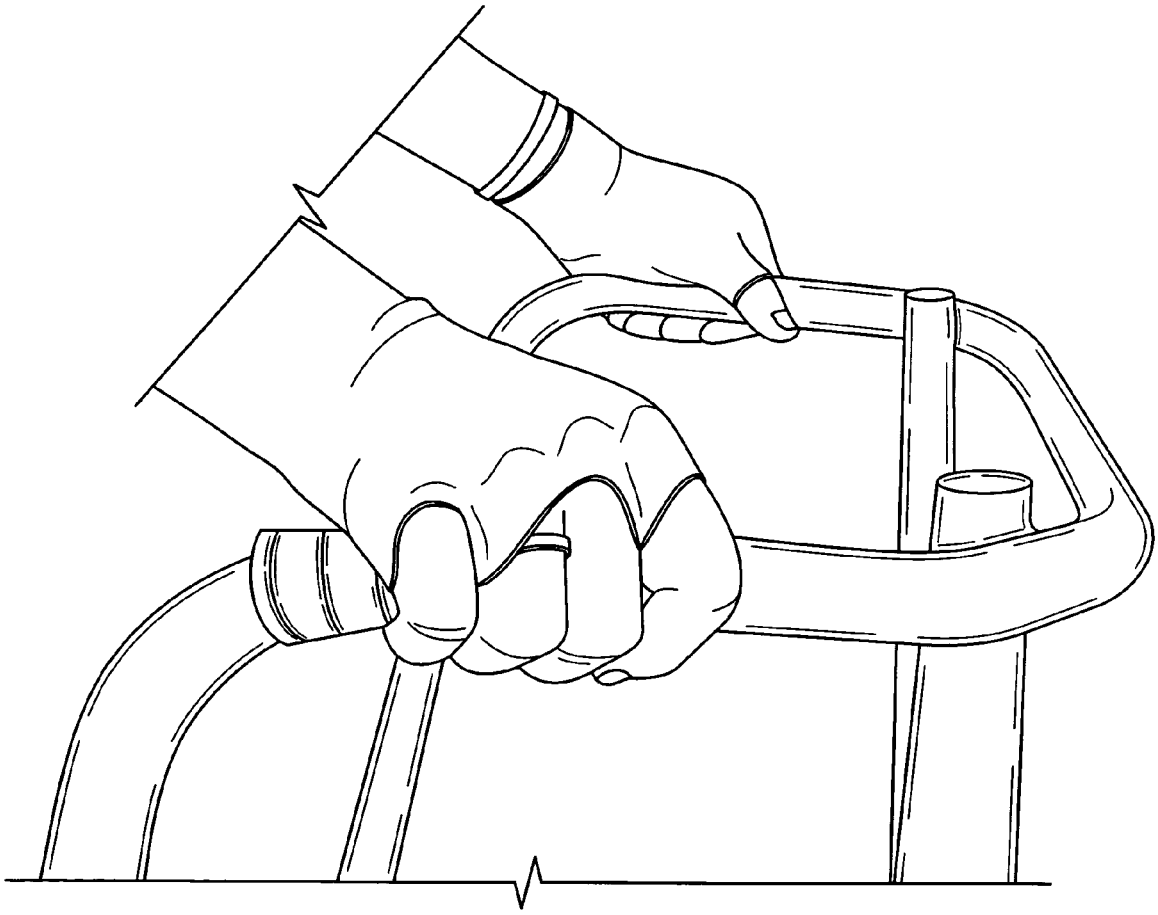
FIG. 20 is a perspective view of a user wearing a multipurpose glove, according to the present invention, the wearer being engaged in a third weight bearing activity.

A contoured, resilient pad 30 is mounted in a base portion 24 of the body corresponding to and for engaging the palm of the user's hand. Preferably, the pad has, along one face 31, at least one lobed portion 32 and is molded so as to generally fit the contour of the palm, the opposite face 33 being relatively flat for engaging an interior portion 25 of the base portion. The palm portion 34 of the pad corresponding to the lobed portion, e.g., clover or petal shaped, and base 26 of the user's palm is generally greater in thickness than that corresponding to the ball 27 of the hand. As shown in FIGS. 19A and 19B, upon engagement of the pad with the user's palm, and of an exterior portion 28 of the base portion with a selected supporting surface 40, the pad causes the base of the palm to be lifted a selected distance generally greater than the distance of lift of the ball and midsection 29 of the user's palm, so as to minimize stress on the user's hand and/or wrist.

According to another embodiment, the pad has, along one face, a plurality of lobed portions 32 extending to one or more selected locations in proximity to the user's wrist, and being molded so as to generally fit the contour of the palm, the opposite face being relatively flat for engaging the interior portion of the base portion. The palm portion of the pad corresponding to the lobed portions is generally greater in thickness than that corresponding to ball 27 of the hand, whereupon engagement of the pad with the user's palm, and of exterior portion 28 of the base portion with the selected supporting surface, the pad causes base 26 of the palm to be lifted a selected distance generally greater than the distance of lift of the ball and midsection of the user's palm, so as to minimize stress on the user's hand and/or wrist.

Figure 6B:
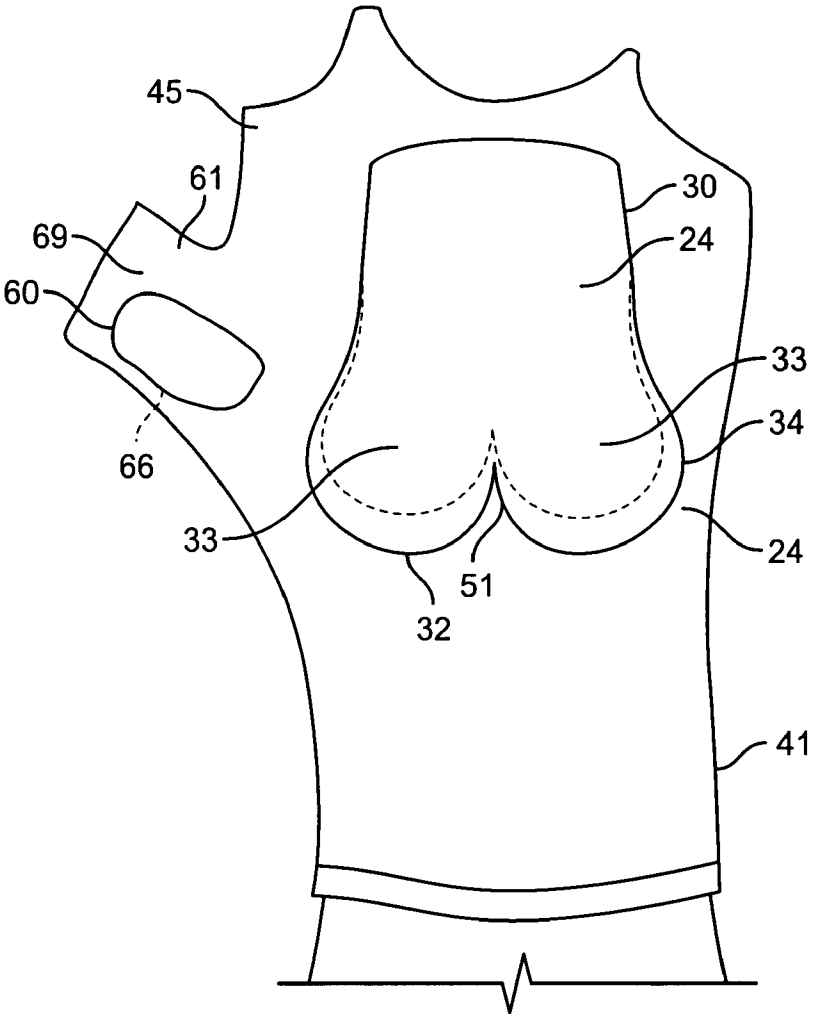
FIG. 6B is a plan view of a left handed version of the multipurpose glove shown in FIG. 6A.
Figure 6A:
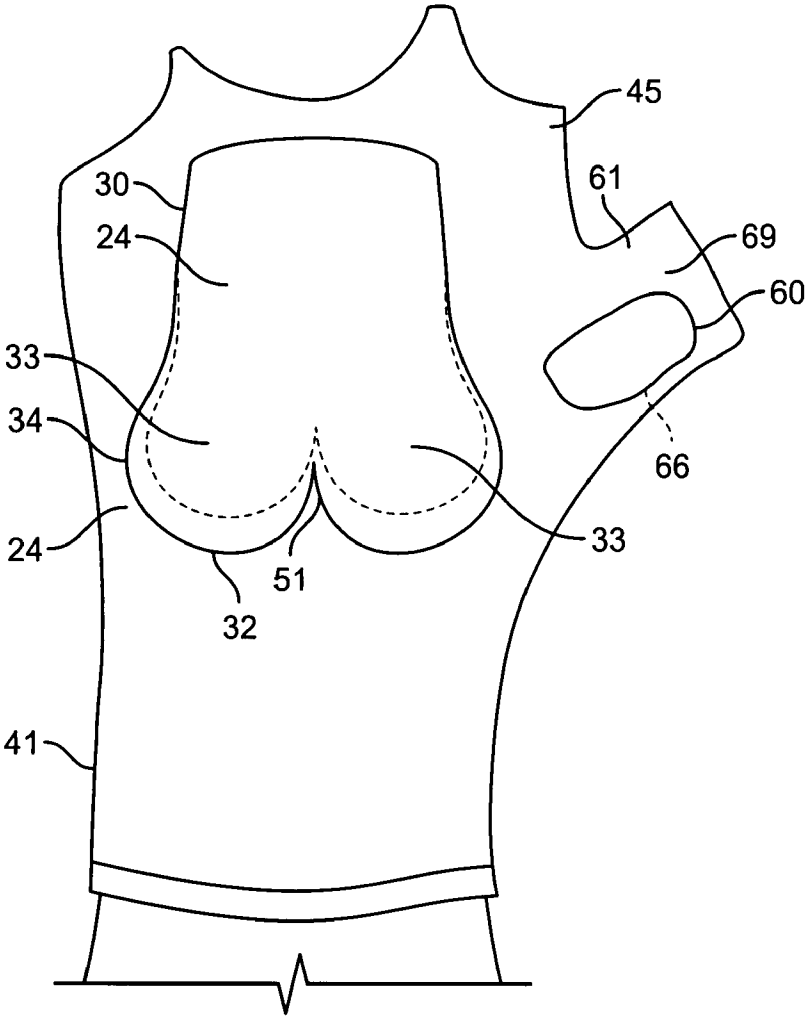
FIG. 6A is a plan view of right handed, multipurpose glove, according to one aspect of the present invention, mounting a contoured, resilient pad corresponding to and for engaging the palm of a user's hand and a contoured, resilient pad mounted in a finger portion of the body corresponding to and for engaging a palm side of the user's thumb.

Desirably, as illustrated in FIGS. 5, 6A and 6B, pad 30 is contoured at selected pressure points 33 of the lateral and medial wrist bones so as to provide a cradling effect for maximum comfort and stability during use. As best seen in FIGS. 11-13C, the pad is also rounded and slightly elevated or raised in the palm or center thereof 34 and radially from the palm or toward the thumb so as to support the arches of the user's hand. In this connection, the lobed portion(s) preferably engage the user's wrist at the inbound end so as to cradle the heel or base of the hand. This arch support arrangement is considered beneficial for helping to insure correct hand placement on the pad during glove use, such as during an exercise routine. It also serves to cradle the user's palm and, thereby, minimizes slippage of the palm from the pad, especially during weight bearing activities.

Figure 13A:
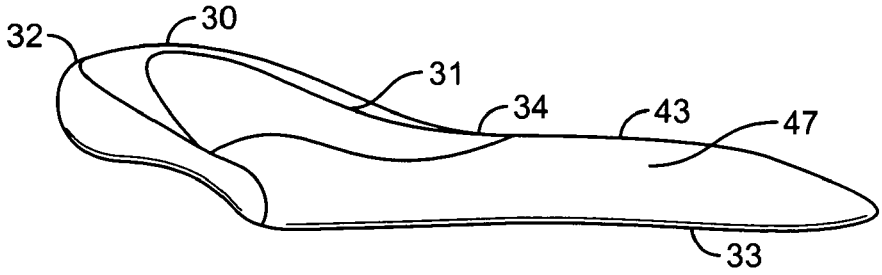
FIG. 13A is a side view of the pad illustrated in FIG. 12.

In accordance with one arrangement, the one or more adjacent lobed portions extend to a proximal end 41 of the glove body, namely, in proximity to user's wrist 21, the lobed portions crossing the user's palm and ending preferably just below the metacarpal phalangeal joints or knuckles 42. The lobed portions each preferably comprise suitable gel padding 50 generally within a range of 0.25 inch and 0.50 inch in thickness over the user's wrist and tapering to about 0.0625 inch where the glove and padding ends, i.e., just below the metacarpal-phalangial joints. As best seen in FIG. 13A, this taper or declining wedge 43, in turn, decreases the degree of wrist extension of the user by about 5° and about 8°, thus eliminating wrist strain in the weight bearing position.

For additional support and stability, the padding is desirably contoured to the natural shape of the wrist in the weight bearing position. As also best seen in FIGS. 5 and 12, a V-shaped notch 51 is defined between adjacent lobed portions 44*a* and 44*b* such as where the median nerve 52 transverses the user's wrist. More particularly, by providing the V-shaped notch in the padding, contact between the padding and the user's medial nerve are avoided. Hence, when using the gloves, according to the present invention, application of compression forces at the area where the median nerve transverses the wrist is advantageously eliminated during weight bearing activities or other usage of the glove. Optionally, slight indentations, or a relatively softer gel density, may be utilized at, or in proximity to where, the scaphoid, trapezium and triquetrum carpel bones 53 protrude to minimize pressure points.

The relative size of V-shaped notch 51 varies according to the size of the glove, suitable notch dimensions typically ranging from about 0.5 inch wide and about 1 inch long to approximately 1 inch wide and around 1½ inches long. Although this range is considered suitable for most applications of the present invention, it is understood that the size and proportion of the notch may be varied further, depending upon the purpose for which the glove is intended and the hand size(s) to be accommodated.

Figure 13B:
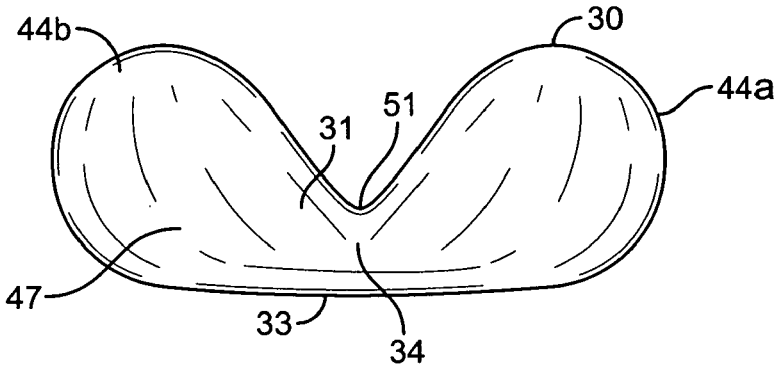
FIG. 13B is a bottom end view of the pad shown in FIG. 12.
Figure 13C:
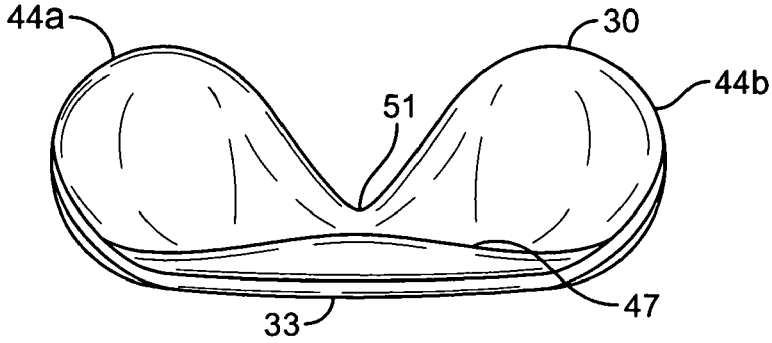
FIG. 13C is a top end view of the pad shown in FIG. 12.

At a distal end 45 of the body, i.e., in a direction generally toward the user's finger tips 46, the gel padding, according to the present embodiment, is approximately 0.0625 inch in width. As shown in FIGS. 13A-13C, it is preferred that the padding gradually taper from the proximal end to the distal end so as to form a mild wedge or decline 47 over the cross section of the padding and, thereby, fit along the contour of a typical user's palm, top to bottom. In this manner, the present invention accomplishes a decrease in wrist extension between about 5° and about 8°. As a result, the user's undesirable bearing of his or her weight on the hands during exercise or other activities with the wrists in full extension or hyperextension (i.e., at a 90° angle or greater) is prevented.

Optionally, the gel padding provided in each glove can vary from a relatively low or soft density of about Shore A-12 durometer to a relatively high or firm density of about Shore A-30 durometer. While the present invention is shown and described as using the same general durometer density the glove for both the right and left hands, and the padding being of relatively uniform density of the durometer selected, those skilled in the art will appreciate that other density arrangements and combinations may be utilized, giving consideration to the purpose for which the present invention is intended.

For instance, a glove for one hand of the user may utilize a selected density of about 12 durometer while the glove for the other hand is of a selected density of approximately 25 durometer, within the spirit and scope of the present invention. In addition, the density of each gel pad may comprise dual densities or other multiple densities of variable degrees, ranging, for example, from about 12 durometer in proximity to the base of the user's palm to more firm support adjacent to the ball of the hand, e.g., a density of around 30 durometer. Gradually varying density gel pads having gradually varying densities across their length and/or modular gel pad components corresponding to selected portions of the user's hand may also be utilized, one or more of the components of the modular pads having densities that differ from the other gel pad components for the same glove, giving consideration to the purpose for which the present invention is intended.

Figure 5A:
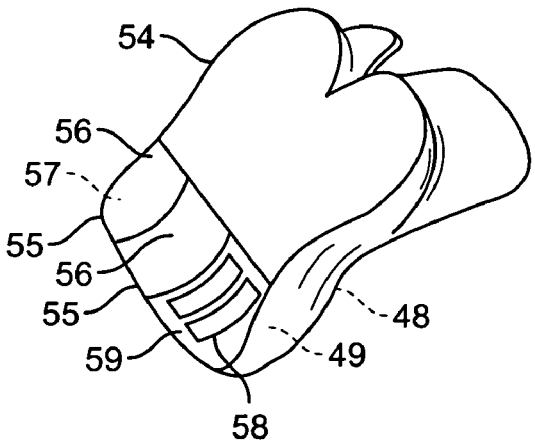
FIG. 5A is a perspective view of a contoured, resilient pad, according to another aspect of the present invention.

Further in the alternative or concurrently therewith, at least one selected portion 54 of the pad, a plurality of selected portions 55, and/or collectively, the pad comprises one or more units or cells 56, each containing a resilient compound 57, for providing padding to the user's palm and/or thumb. A configuration of this general description is shown in FIG. 5A. Such units or cells preferably take the form of relatively thin or flat pads 58 strategically placed about the user's palm and/or thumb. Further in the alternative or concurrently therewith, liquid filled pads are utilized. Such pads comprise, for instance, a plurality of urethane membranes sealed about a relatively low viscosity liquid, e.g., pads sold by Liquicell Technologies, Inc. under the product name LIQUICELL.

Other suitable compounds include, but are not limited to, silicone, silicone gel, viscoelastic polymers, viscoelastic polymer gel, thermoplastic elastomers (TPE), thermoplastic rubbers (TPR), fluids such as glycerine, gelatine, water, air or the like, or other material, taken alone or in combination with other materials, so as to be suitable for improving comfort and/or equalizing vertical pressure at the desired point(s) of contact. An objective, again, is to improve comfort and to reduce soft tissue compression and associated pain of the user's hand and/or wrist.

In accordance with one arrangement, the liquid filled pads are strategically placed within the glove, over wrist 21 and weight-bearing surface(s) 48 of the hand. Preferably, strategically placed seal points 59 control the flow of liquid within the pad and provide a cushiony lubrication, at a selected point of contact 49 on the user's body, desirably the user's hand and/or wrist. One purpose is to decrease discomfort by equalizing vertical pressure at the point of contact and, thereby, reduce soft tissue compression. In this connection, it is also preferred that the liquid-filled pads be relatively thin and lightweight so as to provide a generally less bulky alternative to the user for reducing pressure and discomfort.

Figure 14:
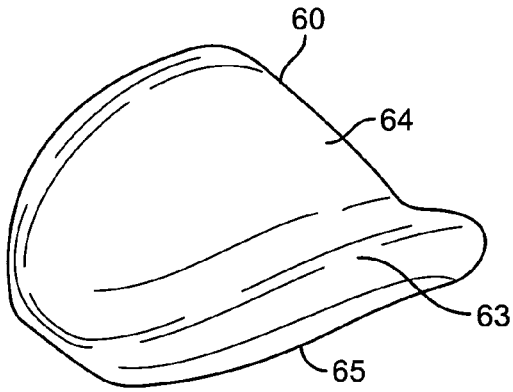
FIG. 14 is a perspective view of a contoured, resilient pad mounted in a finger portion of the body corresponding to and for engaging a palm side of the user's thumb.
Figure 15A:
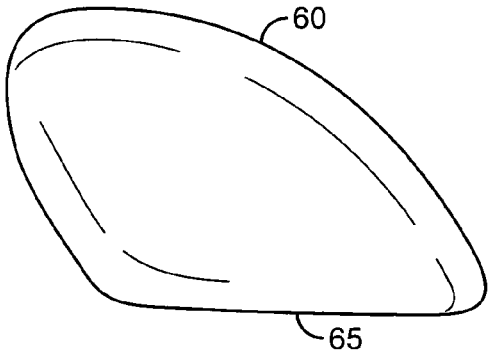
FIG. 15A is a side view of the pad illustrated in FIG. 14.
Figure 15B:
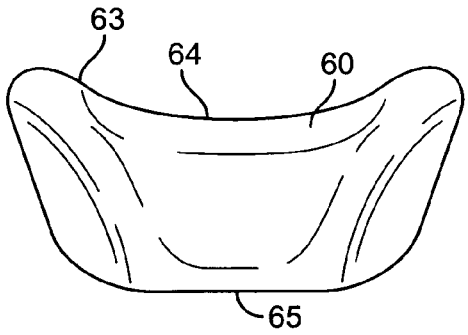
FIG. 15B is a bottom end view of the pad shown in FIG. 14.
Figure 15C:
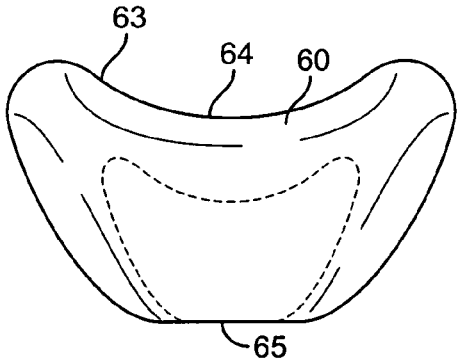
FIG. 15C is a top end view of the pad shown in FIG. 14.
Figure 16:
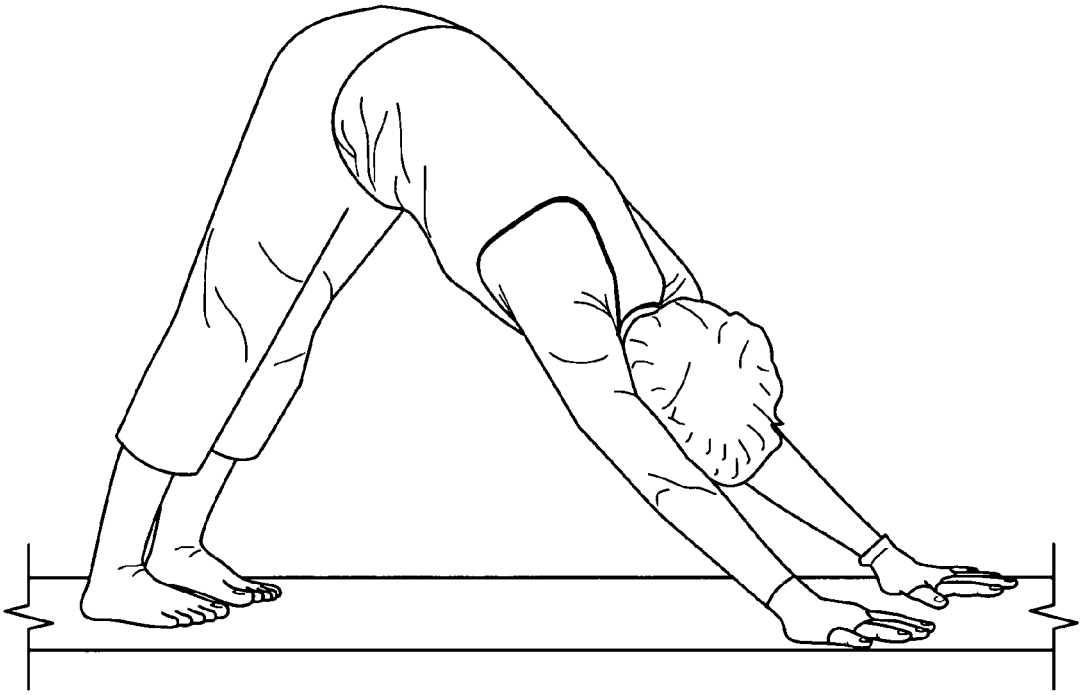
FIG. 16 is a perspective view of a user wearing a multipurpose glove, according to the present invention, the wearer being engaged in a first weight bearing activity.
Figure 17:
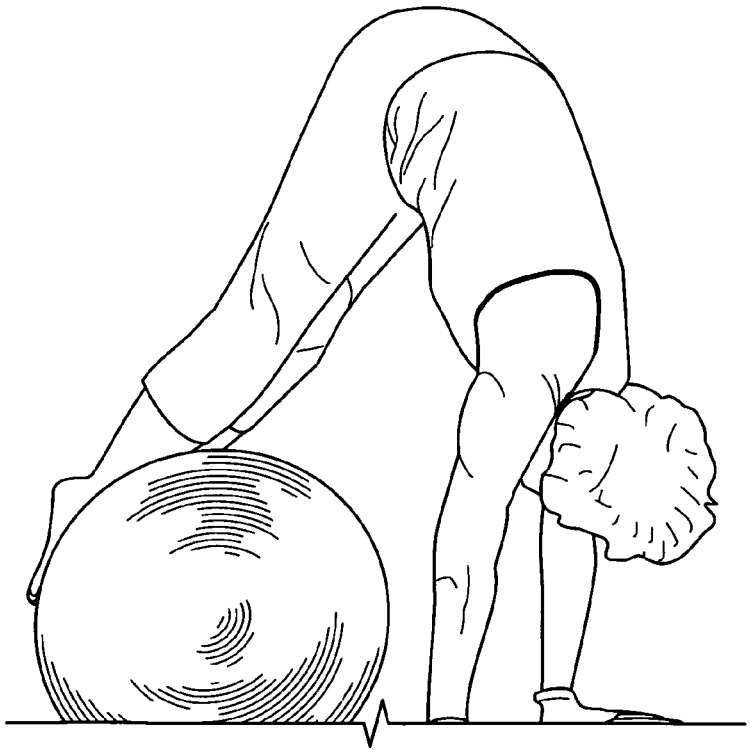
FIG. 17 is a perspective view of a user wearing a multipurpose glove, according to the present invention, the wearer being engaged in a second weight bearing activity.
Figure 18:
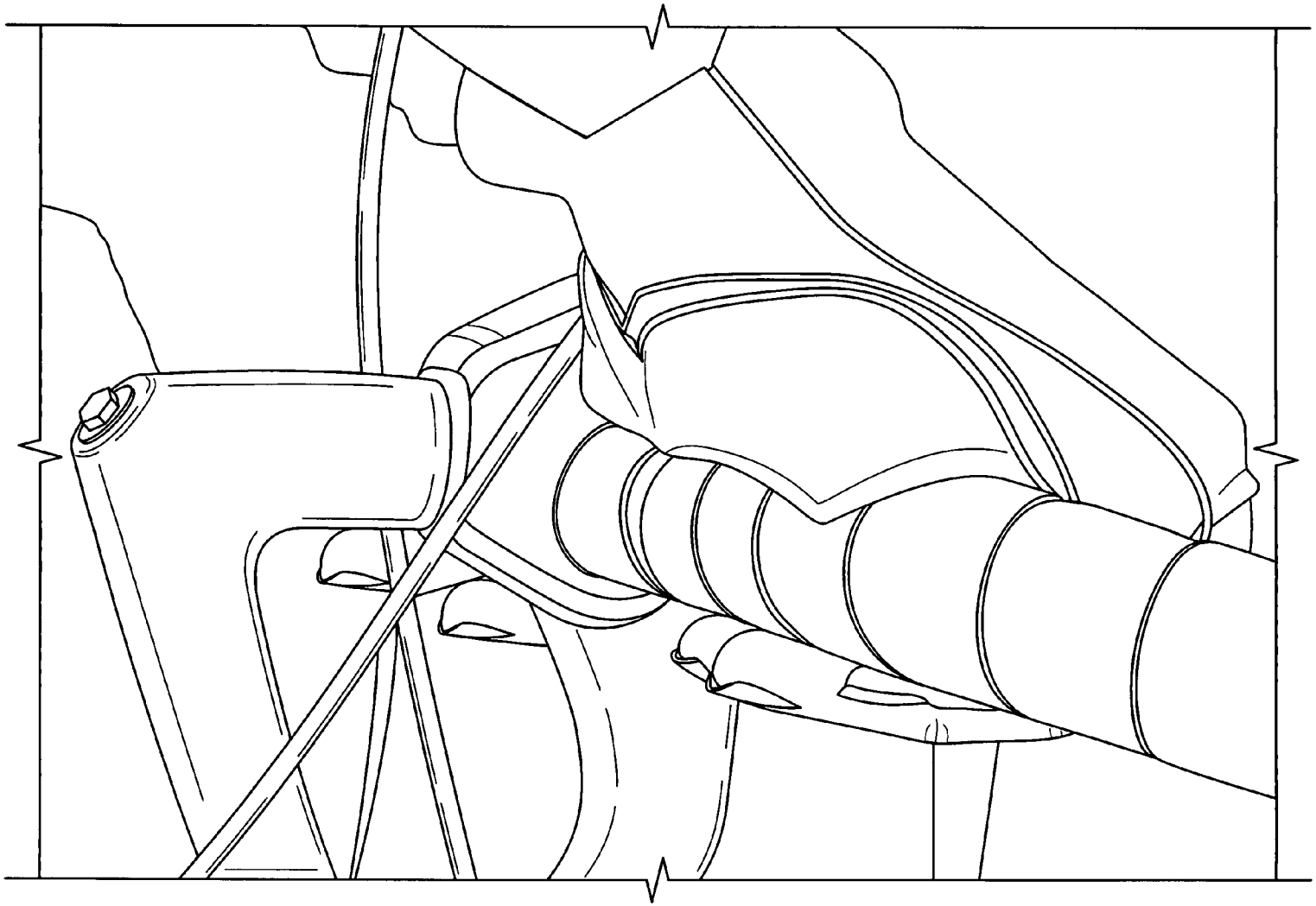
FIG. 18 is a perspective view of a user wearing a multipurpose glove, according to the present invention, the wearer being engaged in a third weight bearing activity.

According to another aspect of the present invention, and alternatively or concurrently with the foregoing, a contoured, resilient pad 60 is mounted in a finger portion 61 of the glove body corresponding to and for engaging palm 62 of the user's thumb 17. It is preferred that thumb pad 60 provide support to the thumb along the proximal phalange between the metacarpophalangeal (MCP) joint and the interphalangeal (IP) joint. As shown in FIGS. 14-15C, the pad desirably has, along one face 63, at least one sloping trough shaped portion 64 and is molded so as to generally fit the contour of the thumb, an opposite face 65 being relatively flat for engaging an interior portion 66 of the base portion, the sloping trough shaped portion of the pad corresponding to a proximal portion 67 of the thumb being generally greater in thickness than that corresponding to a distal portion 68 of the thumb. Upon engagement of the pad with the user's thumb, and of an exterior portion 69 of finger portion 61 with a selected supporting surface 70, the pad causes the proximal portion to be lifted a selected distance 71 generally greater than the distance of lift 72 of the distal portion, so as to minimize stress on the user's hand and/or wrist.

Preferably, the thumb pad is tapered, being generally wider and thicker at the back or proximal end, narrowing in width and declining to a thinner tapered front or distal end. The lateral side of the thumb at the proximal phalange rests in and is supported by the pad when the hand is in a weight bearing position, e.g., palms down. It is also preferred that the thumb pad curve around the top, backside of the thumb and the bottom, palm side of the thumb, contouring around and, in effect, cradling the user's thumb such that the thumb is well-supported and remains in an optimal desired position on the pad.

Advantageously and optionally, the thumb pad is used in conjunction with the wrist-palm pad, both being mounted such as by sewing into a selected position on the glove, for maximum support of the user's hand, within the spirit and scope of the present invention. Moreover, the sloping trough shaped portion of the thumb pad, whether used independently or in combination with one or more finger notch arrangements described above, also aids in maintaining the glove in a selected location, e.g., correctly positioned, on the user's hand, while the fingers remain free.

Although the present invention is shown and described as mounting the thumb and palm pads to interior portions of the glove body, it is understood that the pads may be secured to other glove surfaces, e.g., to exterior portions of the glove body, or secured in alternative ways, giving consideration to the purpose for which the present invention is intended. For instance, as shown in FIG. 9, the pads may be located in a pocket formed in the glove body, removed and/or replaced with pads of differing resilience, as desired, within the spirit and scope of the present invention.

Still another aspect of the present invention is directed to a glove having alternatively arranged contoured, resilient pads. More particularly, contoured, resilient pad 30 is mounted in the base portion of the body corresponding to and for engaging the palm of the user's hand. The pad has, along one face, one or more lobed portions and is molded so as to generally fit the contour of the palm, the opposite face being relatively flat for engaging the interior portion of the base portion. Specifically, the ball portion of the pad corresponding to the lobed portion(s) is generally greater in thickness than that corresponding to the palm portion of the hand. Upon engagement of the pad with the user's palm, and of the exterior portion of the base portion with a selected supporting surface, the pad causes the ball and midsection of the palm to be raised or lifted a selected distance generally greater than the distance of lift of the base of the user's palm, so as to minimize stress on the user's hand.

Optionally, contoured, resilient pad 60 is mounted in the finger portion of the body corresponding to and for engaging the palm side of the user's thumb. The pad has, along one face, at least one sloping trough shaped portion 64 and is molded so as to generally fit the contour of the thumb, the opposite face being relatively flat for engaging the interior portion of the base portion. Notably, the sloping trough shaped portion of the pad corresponding to the distal portion of the thumb is generally greater in thickness than that corresponding to the proximal portion of the thumb. Alternatively, the sloping trough shaped portion of the pad corresponding to the proximal portion of the thumb is generally greater in thickness than that corresponding to the distal portion. Upon engagement of the pad with the user's thumb, and of the exterior portion of the finger portion with a selected supporting surface, the pad causes the distal portion to be lifted a selected distance generally greater than the distance of lift of the proximal portion, so as to minimize stress on the user's hand.

Figure 7:
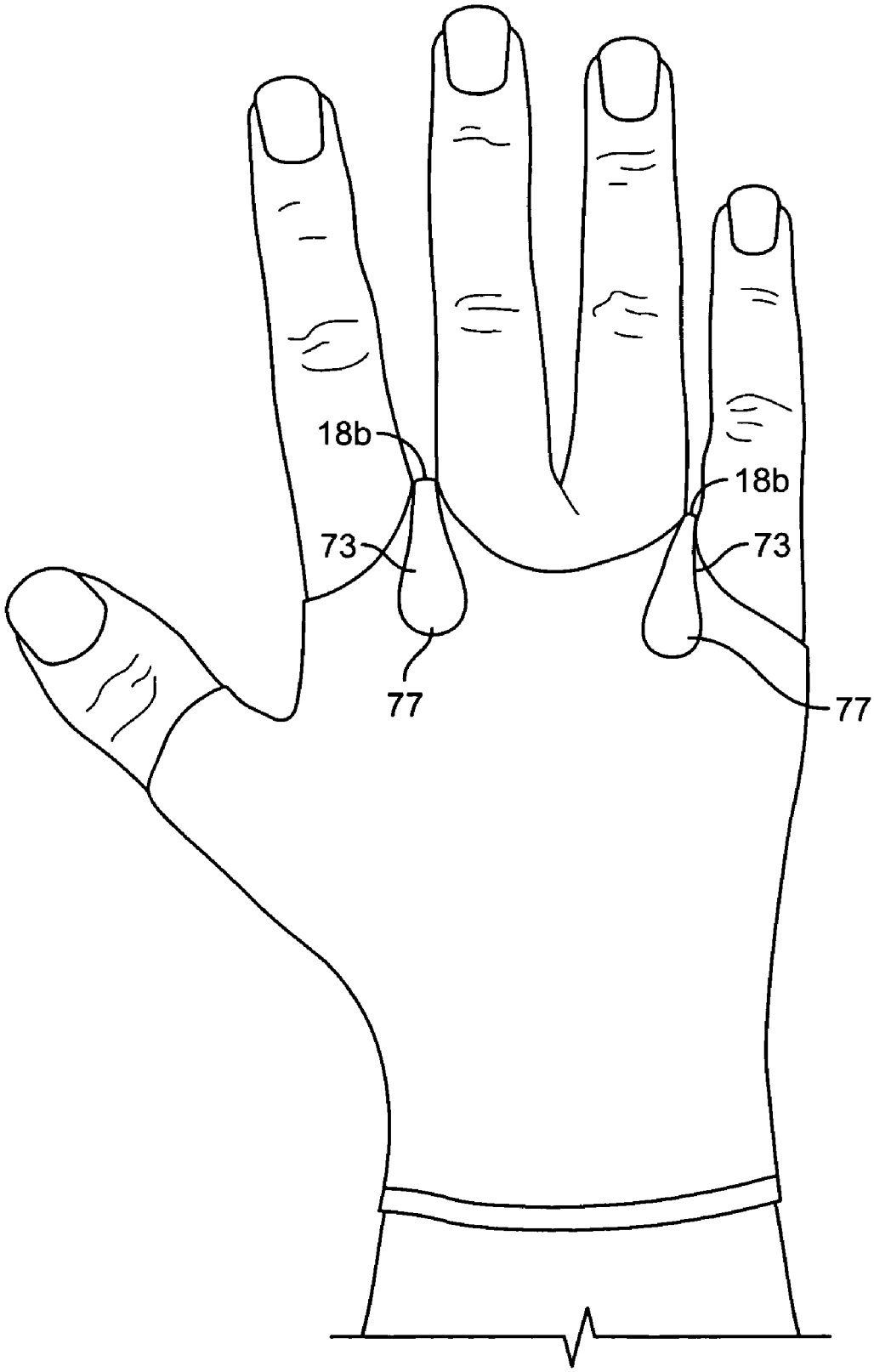
FIG. 7 is a plan view of a multipurpose glove having a two notch arrangement, one notch between the user's index and middle finger and another between the user's ring and little finger, and an adjustable tab member at each notch in a stowed position.
Figure 8:
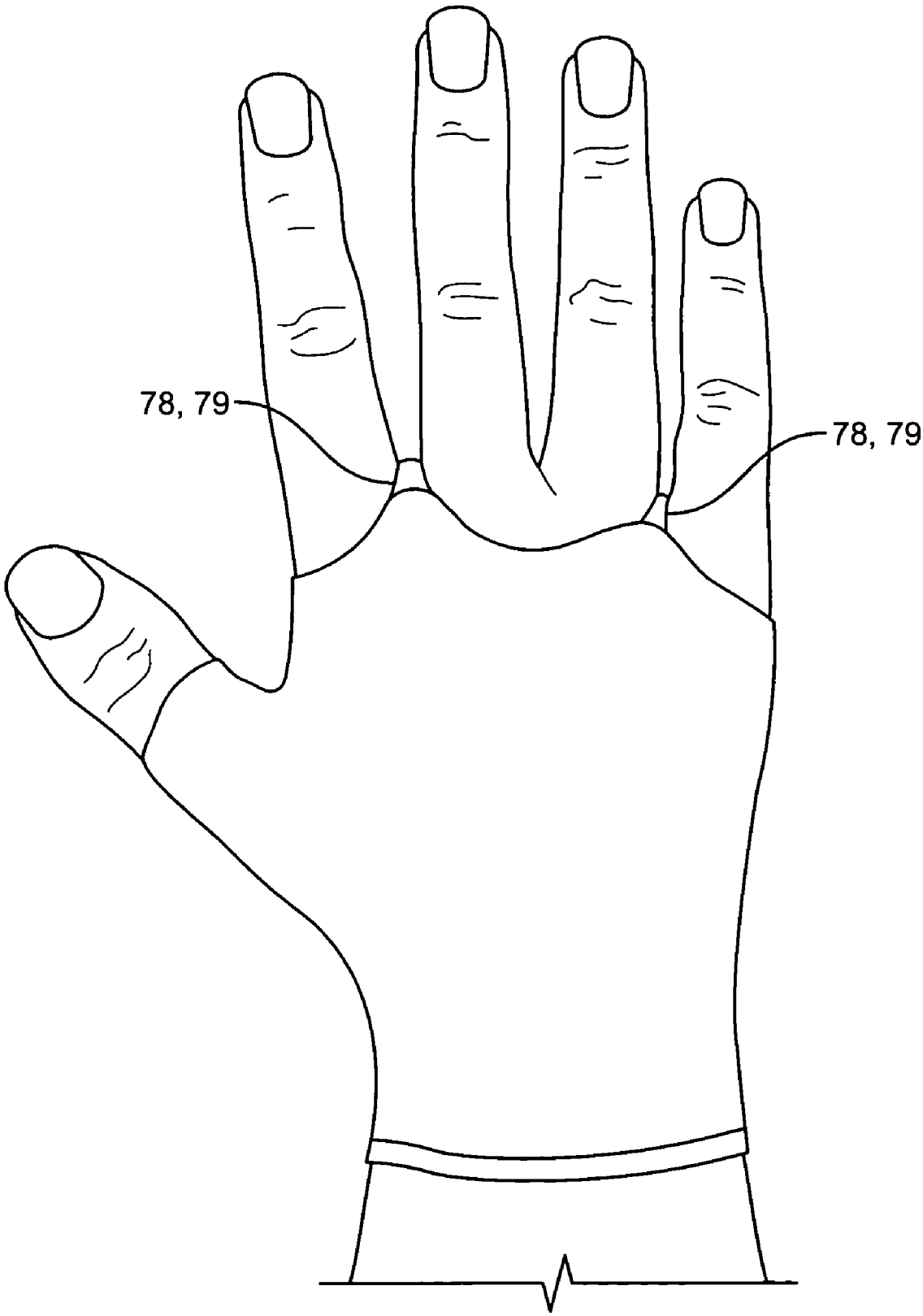
FIG. 8 is a plan view of a multipurpose glove with a two notch arrangement, one notch between the user's index and middle finger and another between the user's ring and little finger, and a securement strip at each notch in a stowed position.
Figure 10:
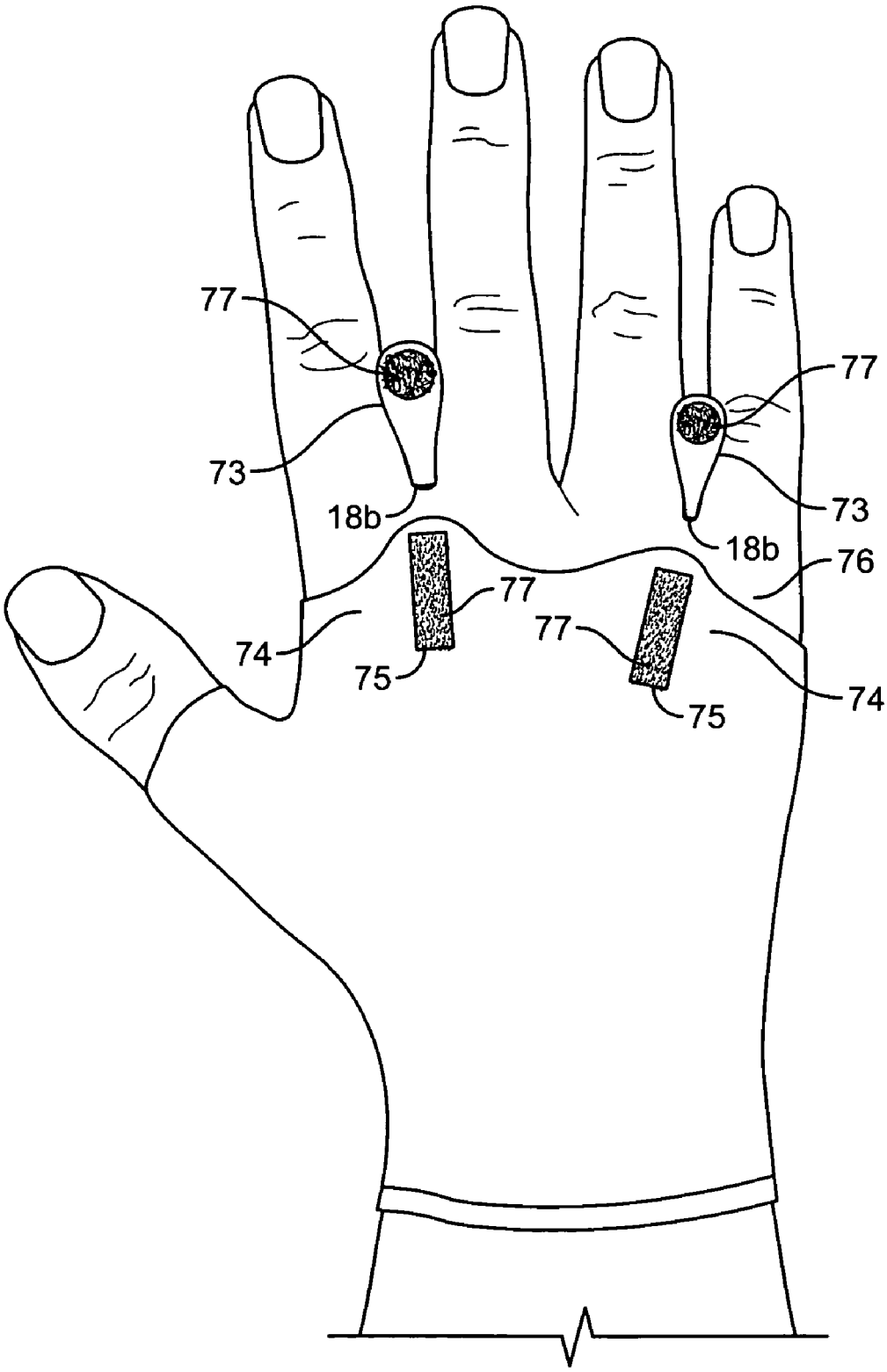
FIG. 10 is a plan view of the glove shown in FIG. 7 with the adjustable tab member at each notch in an operative position.
Figure 11:
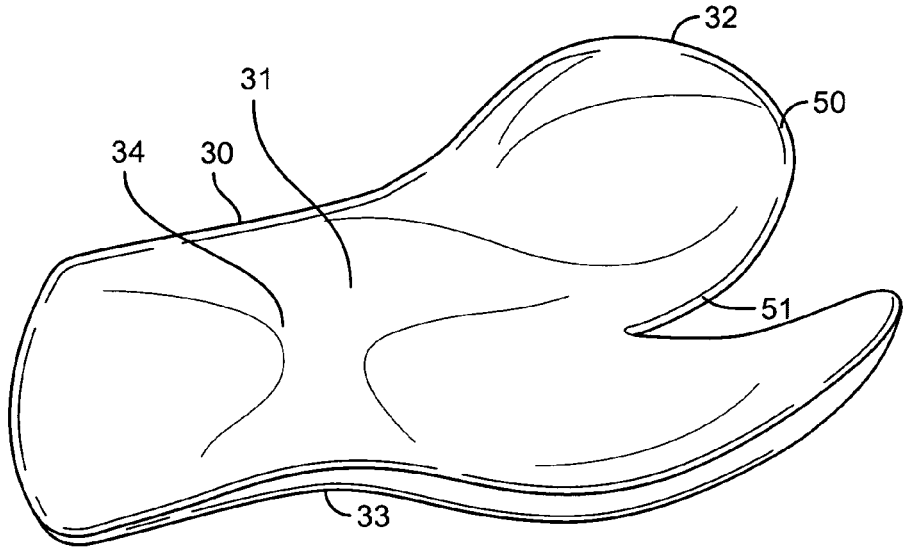
FIG. 11 is a reverse perspective view of the contoured, resilient pad shown in FIG. 5 disengaged from a user's hand.
Figure 12:
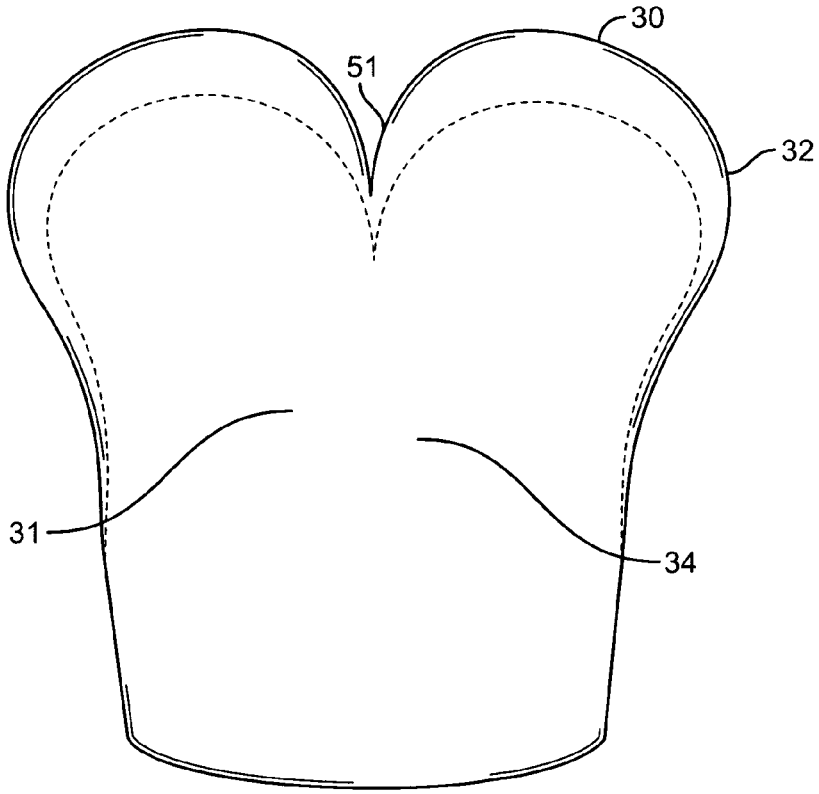
FIG. 12 is a plan view of the contoured, resilient pad shown in FIG. 11.

Turning now to yet another embodiment of the present invention, set forth in FIGS. 7 and 10, at least one of the notches 18*b* between the user's fingers includes an adjustable tab member 73 removably attached to one side 74 of the glove, preferably in proximity to the palm portion, for positioning and securing the glove in a desired position. Alternatively or concurrently, the tab member is detachable so as to be removed entirely from the glove body, in accordance with the present invention. In operation, each tab member 73 is pulled through the user's fingers between which it is positioned to a selected tightness and then secured to a surface 75 on an opposite side of the glove, desirably in proximity to and between the user's knuckles 76, using suitable fasteners 77 such as Velcro strips, sewing, buttons, snaps, hooks, ties or the like. According to one arrangement, illustrated in FIG. 8, a plurality of fabric strips 78 come between the user's fingers, one between the index and middle finger, and another between the ring and little finger, from the palm side of the glove to the knuckle side. Velcro fasteners mounted to the underside of the fabric strips or tabs mate with corresponding Velcro fasteners on the back side of the glove so as to prevent the fingers from sliding through the glove. In this manner, the user may adjust the glove strips or tabs by loosening or tightening the same for an adjustable fit of the glove to a selected user's hand and/or optimum performance for the glove application desired.

Alternatively or concurrently, a plurality of strips 79 constructed of a synthetic leather material (or other suitable non-stretch fabric) are mounted to the palm and back portions of the glove, e.g., by sewing, buttons, snaps, hooks, ties or the like. The strips pass between the index and middle finger, and between the ring and little finger, respectively, so as to hold the glove firmly in place on the user's hand. Such non-stretch finger strips or tabs have been found advantageous in holding the glove in place more securely so that the hand does not slide off the declined wedge of the gel padding, upon application by the user of downward forward pressure.

While the present invention has been shown and described in connection with a fingerless design, it is understood that half-finger gloves, full-fingered gloves, and any combination thereof may also be utilized, depending upon the activity and application to which the glove is intended, within the spirit and scope of the present invention. For example, the glove body is optionally provided with fingers in the event that additional securement of the glove to the user's hand is needed during weight bearing activities.

Referring now to yet a further aspect of the present invention, a method is provided for making a multipurpose glove. Initially, a body of the glove is constructed of a relatively resilient material for snug fit reception of a user's hand. A first opening is then formed on a first side of the body for receiving the user's hand, a second opening is formed in the body branching from a second side thereof for receiving the user's thumb, and a plurality of third openings oriented multidirectionally are formed, each of the third openings for receiving at least one finger of the user, at least one of the third openings having a size and shape suitable for receiving and supporting at least one and preferably two of the user's fingers generally simultaneously upon engagement of the glove with the user's hand. Adjacent openings define a notch for guiding the finger passing therethrough into position, and for maintaining and securing the glove in a desired position on the hand.

Next, a contoured, resilient pad is mounted in a base portion of the body, the pad corresponding to and for engaging the palm of the user's hand, the pad having, along one face, one or more lobed portions and being molded so as to generally fit the contour of the palm, the opposite face being relatively flat for engaging an interior portion of the base portion. The palm portion of the pad corresponds to the one or more lobed portions being generally greater in thickness than that corresponding to the ball of the hand. Upon engagement of the pad with the user's palm, and of an exterior portion of the base portion with a selected supporting surface, the pad causes the base of the palm to be lifted a selected distance generally greater than the distance of lift of the ball and midsection of the user's palm, so as to minimize stress on the user's hand and wrist.

Optionally, an additional step is performed, namely, associating an adjustable tab member or strip with the notch for removable engagement of a user's finger with the glove body so as to maintain the fingers in a desired position. As a further option, and alternatively or currently therewith, is a step of mounting a contoured, resilient pad in a finger portion of the body corresponding to and for engaging a palm side of the user's thumb. The pad has, along one face, at least one sloping trough shaped portion and being molded so as to generally fit the contour of the thumb. The opposite face is relatively flat for engaging an interior portion of the base portion. The sloping trough shaped portion of the pad corresponding to a proximal portion of the thumb is generally greater in thickness than that corresponding to a distal portion of the thumb. Upon engagement of the pad with the user's thumb, and of an exterior portion of the finger portion with a selected supporting surface, the pad causes the proximal portion to be lifted a selected distance generally greater than the distance of lift of the distal portion, so as to minimize stress on the user's wrist, hand and/or thumb.

Further in the alternative, or concurrently therewith, a method is provided for securing a multipurpose glove to a user's hand. The glove has a body of a relatively resilient material for snug fit reception of a user's hand, the body including a first opening on a first side for receiving the user's hand, a second opening branching from a second side of the body for receiving the user's thumb, and a plurality of third openings oriented multidirectionally. Each of the third openings receives at least one finger of the user, at least one of the third openings having a size and shape suitable for receiving and supporting at least one and preferably two of the user's fingers generally simultaneously upon engagement of the glove with the user's hand. Adjacent openings define a notch for guiding the finger passing therethrough into position, and for maintaining and securing the glove in a desired position on the hand. In this connection, the user first passes his or her hand and fingers through the first opening, pulling the glove body over the hand. Each finger of the hand is in alignment with a corresponding first, second and third opening in the body, such that each finger is guided by the corresponding opening and passes therethrough so as to achieve snug fit reception of the user's hand and fingers. At least one web portion between adjacent fingers engages and abuts an adjustable tab member associated with the notch, the tab member being removably attached to the glove body for maintaining and securing the user's fingers in a desired position. Next, the tab member is detached from one side of the glove body, and pulled between the user's fingers between which it is positioned to a selected tightness. Finally, the tab member is fastened to the one side of the glove body so as to maintain the selected degree of tightness during use.

Overall, the present invention improves comfort and relieves stress and strain on the wrist and hand. It also provides for considerable reduction in and elimination of joint pain, decrease in compression, stress and strain on soft tissues of the wrist soft tissues (e.g., nerves, ligaments, tendons, muscles and blood vessels), particularly, but not exclusively, during weight bearing activities such as floor exercises, Yoga, Pilates, gardening, keyboarding, cycling and the like (See FIGS. 16-20). More specifically, the multipurpose glove of the present invention not only substantially increases the wearers comfort, but also minimizes stress and strain on the soft tissues (e.g., nerves, ligaments, tendons, muscles and blood vessels) associated with prolonged or repeated stretch and pressure that occurs when weight bearing with the wrist in a fully extended position on a hard surface (such as the floor during Yoga, the ground while gardening, handlebars during cycling, a cane or walker, etc.) One feature is the provision of ergonomically designed gel padding over weight bearing surfaces of the hand and wrist, while providing a V -shaped channel or recessed area of support for eliminating compression below the palm of the hand, i.e., where the median nerve transverses the wrist and palm.

The multipurpose glove is beneficial for people of all ages who seek protection of joints and soft tissues (e.g., nerves, ligaments, tendons, muscles, blood vessels and the like) during weight bearing activities on their hands. It is also deemed advantageous for Yoga, Pilates or other exercise or fitness activities for minimizing wrist strain and improving comfort during sustained weight bearing. Further benefits may be derived by those who experience pain in one or both wrists from sustained pressure and weight bearing, and by those who suffer from carpel tunnel syndrome, arthritis or osteoporosis.

Various modifications and alterations to the present invention may be appreciated based on a review of this disclosure. These changes and additions are intended to be within the scope and spirit of the invention as defined by the following claims.

What is claimed is:

1. A method of securing a multipurpose glove to a user's hand, the glove having a body of a relatively resilient material for snug fit reception of a user's hand, the body including a first opening on a first side for receiving the user's hand, a second opening branching from a second side of the body for receiving the user's thumb, and a plurality of third openings oriented multidirectionally, each of the third openings for receiving at least one finger of the user, at least one of the third openings having a size and shape suitable for receiving and supporting at least two of the user's fingers generally simultaneously upon engagement of the glove with the user's hand, adjacent openings defining a notch for guiding the finger passing therethrough into position, and for maintaining and securing the glove in a desired position on the hand; the method comprising the steps of:

passing the user's hand and fingers through the first opening;

pulling the glove body over the hand, each finger of the hand being in alignment with a corresponding first, second and third opening in the body, such that each finger is guided by the corresponding opening and passing therethrough so as to achieve snug fit reception of the user's hand and fingers, at least one web portion between adjacent fingers engaging and abutting an adjustable tab member associated with the notch, the tab member being removably attached to the glove body for maintaining and securing the user's fingers in a desired position;

detaching the tab member from one side of the glove body;

pulling the tab member between the user's fingers between which it is positioned to a selected tightness; and securing the tab member to the one side of the glove body so as to maintain the selected degree of tightness during use.

2. The glove set forth in claim 1, further comprising a contoured, resilient pad corresponding to and for engaging the palm of a user's hand, the pad having, along one face, at least one lobed portion and being molded so as to generally fit the contour of the palm, the opposite face being relatively flat for engaging at least indirectly a selected support surface, the palm portion of the pad corresponding to the lobed portion being generally greater in thickness than that corresponding to the ball of the hand, whereupon engagement of the pad with the user's palm, and of the opposite face with the selected supporting surface, the pad causes the base of the palm to be lifted a selected distance generally greater than the distance of lift of the ball and midsection of the user's palm, so as to minimize stress on the user's hand.

3. The glove set forth in claim 2 wherein the lobed portion has a clover-like shape.

4. The glove set forth in claim 2 wherein the lobed portion has a petal-like shape.

* * * * *